US010976687B2

(12) United States Patent
Kobayashi

(10) Patent No.: US 10,976,687 B2
(45) Date of Patent: Apr. 13, 2021

(54) DEVELOPING AGENT CONTAINER WITH MOVABLE SHUTTER FOR CLOSING DEVELOPING AGENT SUPPLY HOLE

(71) Applicant: Oki Data Corporation, Tokyo (JP)

(72) Inventor: Yuuki Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/746,104

(22) Filed: Jan. 17, 2020

(65) Prior Publication Data

US 2020/0272070 A1 Aug. 27, 2020

(30) Foreign Application Priority Data

Feb. 26, 2019 (JP) ..... JP2019-032439

(51) Int. Cl.
*G03G 15/08* (2006.01)

(52) U.S. Cl.
CPC ..... *G03G 15/0886* (2013.01); *G03G 15/0865* (2013.01); *G03G 15/0898* (2013.01); *G03G 2215/0692* (2013.01)

(58) Field of Classification Search
None
See application file for complete search history.

(56) References Cited

U.S. PATENT DOCUMENTS

2008/0267658 A1* 10/2008 Takagi ..... G03G 15/0898 399/106
2010/0247160 A1* 9/2010 Ohta ..... G03G 15/0865 399/262
2012/0163877 A1 6/2012 Kikuchi et al.
2013/0216257 A1* 8/2013 Fujimura ..... G03G 15/0877 399/103

FOREIGN PATENT DOCUMENTS

JP 2009-122213 A 6/2009

* cited by examiner

*Primary Examiner* — Victor Verbitsky
(74) *Attorney, Agent, or Firm* — Rabin & Berdo, P.C.

(57) ABSTRACT

A developing agent container includes: a container, a shutter that sets a supply hole to a closed state and an open state, a seal sponge that seals a gap between the first surface and the shutter when the supply hole is in the closed state, wherein the shutter has a first ridge line part that makes contact with the seal sponge due to the movement of the shutter, in a first edge part on a front end side in the first direction, the seal sponge has a second ridge line part that makes contact with the shutter due to the movement of the shutter in the first direction, in a second edge part on the opposite direction's side facing the supply hole, and the first ridge line part and the second ridge line part have a relationship in which one is inclined with respect to the other.

11 Claims, 17 Drawing Sheets

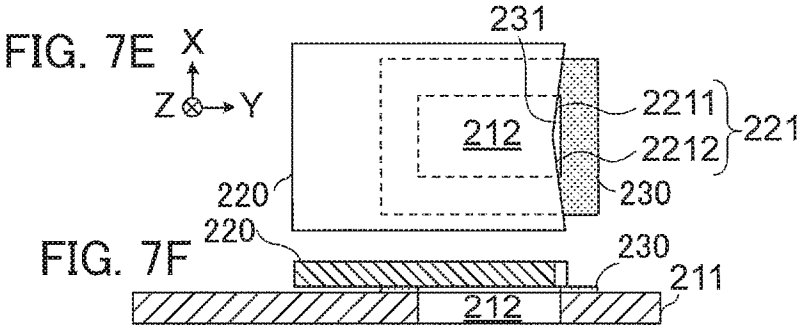
FIG. 7E
FIG. 7F
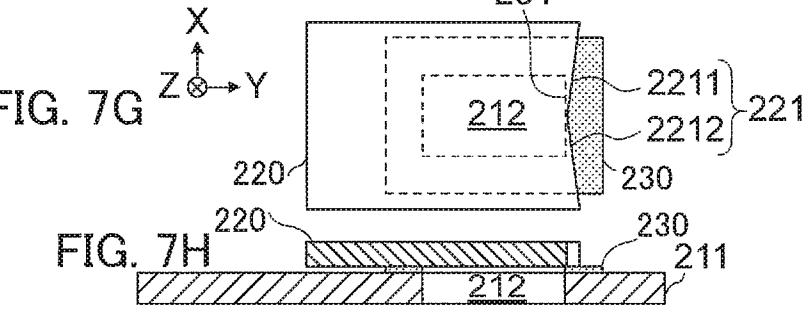
FIG. 7G
FIG. 7H
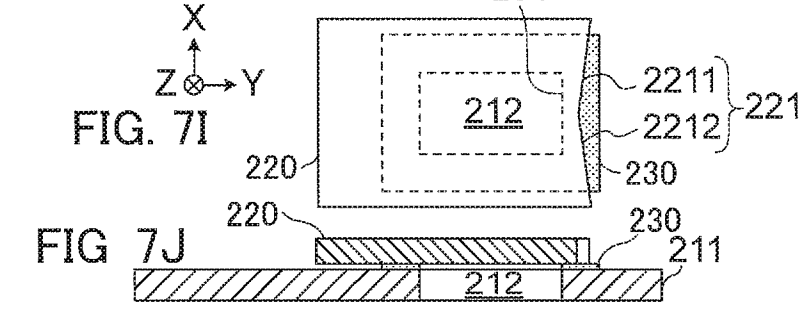
FIG. 7I
FIG 7J
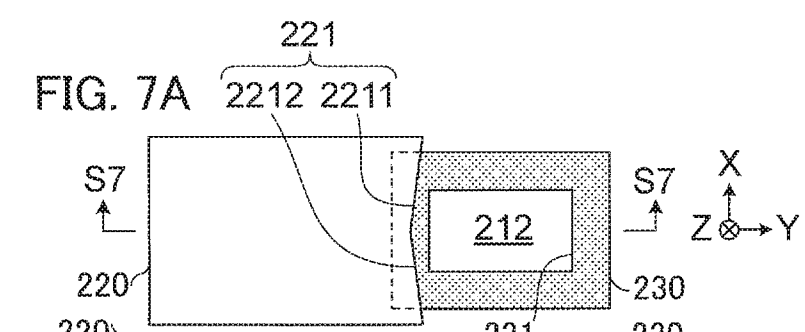
FIG. 7A
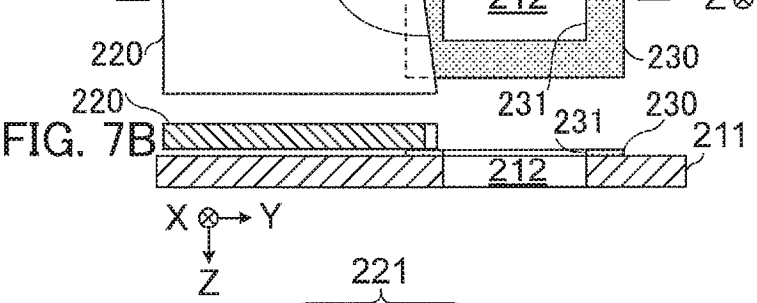
FIG. 7B
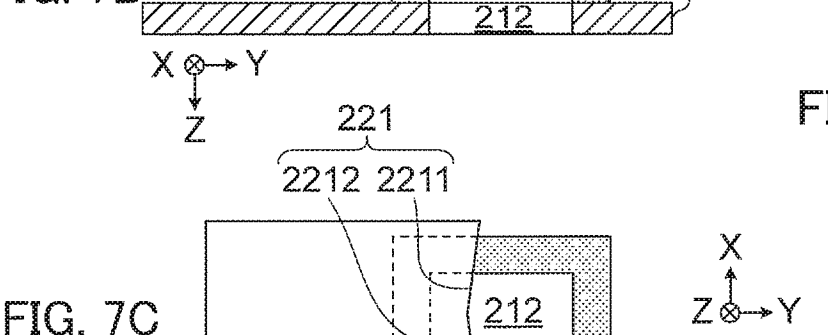
FIG. 7C
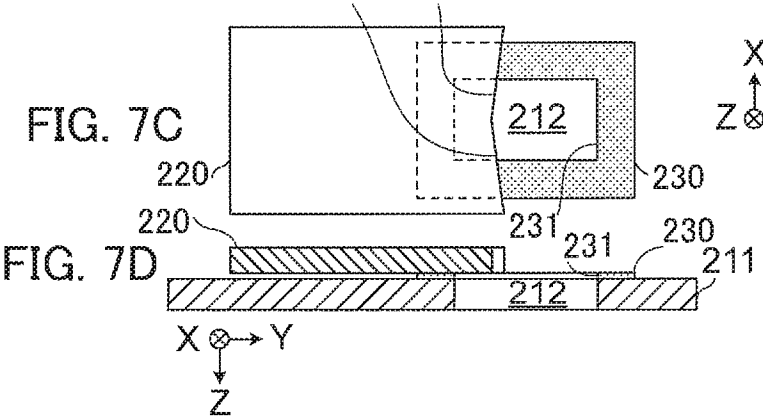
FIG. 7D

S8
8F
212
211
230
231
240
920
921
LEAKAGE
X
Y
Z

DEVELOPING AGENT CONTAINER WITH MOVABLE SHUTTER FOR CLOSING DEVELOPING AGENT SUPPLY HOLE

BACKGROUND OF THE INVENTION

1. Field of the Invention

The present invention relates to a developing agent container and an image forming apparatus.

2. Description of the Related Art

To an image forming apparatus that forms an image on a medium by using the electrophotographic method, a developing agent container storing a developing agent is attached in order to supply the developing agent. The developing agent container is referred to also as a "toner cartridge". The developing agent container includes a container that stores the developing agent, a supply hole (referred to also as a communication hole) for the developing agent as an opening formed through an under surface of the container, and a shutter provided to be slidable with respect to the container so as to open and close the supply hole. See Japanese Patent Application Publication No. 2009-122213 (Patent Reference 1), for example. The supply hole is set to a closed state by sliding the shutter situated at an open position in a prescribed moving direction, and the supply hole is set to an open state by sliding the shutter situated at a closed position in a direction opposite to the moving direction.

Incidentally, to a part of the under surface of the container of the developing agent container around the supply hole, a seal sponge for sealing a gap between the under surface and the shutter is generally stuck. However, in the conventional developing agent container described above, the supply hole formed through the under surface of the container and an outlet hole as an opening formed through the shutter have the same shape. In this case, in the middle of moving the shutter situated at the open position to the closed position, the whole region of an edge part of the shutter simultaneously makes contact with the whole region of an edge part of the seal sponge facing the aforementioned opposite direction, and thus curling is likely to occur to the edge part of the seal sponge. When the curling occurs to the edge part of the seal sponge, a problem arises in that the sealing of the gap between the under surface of the container and the shutter by the seal sponge becomes imperfect and the developing agent leaks out even though the shutter is at the closed position.

SUMMARY OF THE INVENTION

The object of the present invention, which has been made to resolve the above-described problem, is to provide a developing agent container having structure in which the curling hardly occurs to the seal sponge and an image forming apparatus including the developing agent container.

A developing agent container according to an aspect of the present invention includes: a container including a first surface having a supply hole for a developing agent; a shutter that is provided on the container, sets the supply hole to a closed state by moving in a first direction as a direction along the first surface, and sets the supply hole to an open state by moving in a direction opposite to the first direction; and a seal sponge that is stuck to a region of the first surface surrounding the supply hole and seals a gap between the first surface and the shutter when the supply hole is in the closed state. The shutter has a first ridge line part that makes contact with the seal sponge due to the movement of the shutter, in a first edge part on a front end side in the first direction. The seal sponge has a second ridge line part that makes contact with the shutter due to the movement of the shutter in the first direction, in a second edge part on the opposite direction's side facing the supply hole. The first ridge line part and the second ridge line part have a relationship in which one is inclined with respect to the other.

According to the present invention, the curling hardly occurs to the edge part of the seal sponge, and thus an advantage is obtained in that the leakage of the developing agent due to the curling of the seal sponge hardly occurs.

BRIEF DESCRIPTION OF THE DRAWINGS

In the attached drawings,

FIGS. 7A, 7C, 7E, 7G and 7I are bottom views showing a closing operation of a supply hole of the developing agent container according to the first embodiment, and FIGS. 7B, 7D, 7F, 7H and 7J are cross-sectional views showing the closing operation of the supply hole of the developing agent container according to the first embodiment;

DETAILED DESCRIPTION OF THE INVENTION

Figure 1:
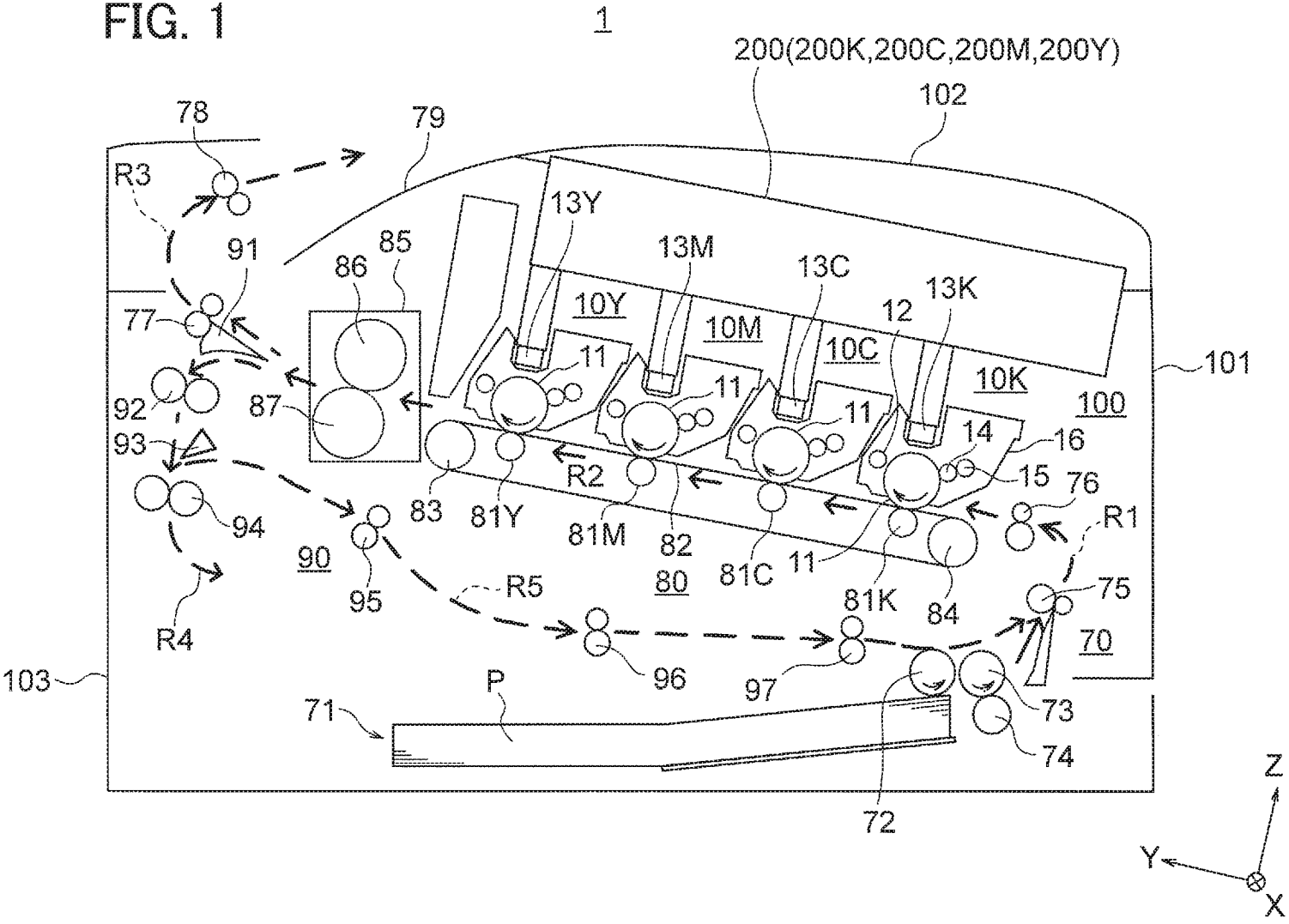
FIG. 1 is a diagram schematically showing vertical sectional structure of an image forming apparatus according to a first embodiment of the present invention.

A developing agent container and an image forming apparatus including the developing agent container according to each embodiment of the present invention will be described below with reference to drawings. Here, the image forming apparatus is a device that forms an image on a medium by using the electrophotographic method, such as a copy machine, a facsimile machine, a printer or a multifunction peripheral. The following embodiments are just examples for the purpose of illustration and a variety of modifications are possible within the scope of the present invention.

Coordinate axes of an XYZ orthogonal coordinate system are shown in each drawing. An X-axis, a Y-axis and a Z-axis are coordinate axes respectively in a width direction, a lengthwise direction and a height direction of the developing agent container. In each embodiment, a +Y direction and a −Y direction are moving directions of a shutter that opens and closes a supply hole of the developing agent container for a developing agent. In the following description, the same components are assigned the same reference character.

(1) First Embodiment

(1-1) Image Forming Apparatus

FIG. 1 is a diagram schematically showing vertical sectional structure of an image forming apparatus 1 according to a first embodiment. The image forming apparatus 1 is a printer that forms a color image on a medium P. The image forming apparatus 1 includes a medium conveyance mechanism 70 that supplies and conveys a medium P such as a print sheet, an image forming section 100 that forms developing agent images made of developing agents on the medium P, and a fixation device 85 that fixes the developing agent images on the medium P. Each developing agent is referred to also as a "toner". Each developing agent image is referred to also as a "toner image". Each developing agent container is referred to also as a "toner cartridge".

The medium conveyance mechanism 70 includes a sheet feed tray 71 that stores the media P, a pickup roller 72 arranged to contact a medium P stored in the sheet feed tray 71, a feed roller 73 arranged adjacent to the pickup roller 72, and a retard roller 74 arranged to face the feed roller 73.

The sheet feed tray 71 stores the media P in a stacked state. The pickup roller 72 rotates while contacting a medium P in the sheet feed tray 71 and thereby draws out the medium P from the sheet feed tray 71. The feed roller 73 sends out the medium P drawn out by the pickup roller 72 to a conveyance path R1. The retard roller 74 prevents multifeed by giving conveyance resistance to the medium P sent out by the feed roller 73.

Further, the medium conveyance mechanism 70 includes conveyance roller pairs 75 and 76 along the conveyance path R1. The conveyance roller pair 75 starts rotating with prescribed timing after a front end of the medium P makes contact with a nip part of the rollers and thereby conveys the medium P while correcting the skew of the medium P. The conveyance roller pair 76 conveys the medium P fed from the conveyance roller pair 75 to the image forming section 100.

The image forming section 100 includes image forming units 10K, 10C, 10M and 10Y as process units that form developing agent images of black (B), cyan (C), magenta (M) and yellow (Y) and a transfer unit 80 that transfer the developing agent images onto the medium P. Print heads 13K, 13C, 13M and 13Y as exposure devices are arranged to respectively face photosensitive drums 11 of the image forming units 10K, 10C, 10M and 10Y.

The image forming units 10K, 10C, 10M and 10Y are arranged in this order in a direction along a conveyance path R2 of the medium P. Each image forming unit 10K, 10C, 10M, 10Y is referred to also as an "image forming unit 10". Further, each print head 13K, 13C, 13M, 13Y is referred to also as a "print head 13".

The image forming unit 10 includes the photosensitive drum 11 as an image carrier that carries the developing agent image, a charging roller 12 as a charging member, a development roller 14 as a developing agent carrier, a supply roller 15 as a supply member that supplies the developing agent to the development roller 14, and a unit frame 16 housing these components.

The charging roller 12 is arranged to contact the surface of the photosensitive drum 11 and rotates following the rotation of the photosensitive drum 11. The charging roller 12, to which charging voltage is applied, uniformly charges the surface of the photosensitive drum 11. An electrostatic latent image is formed on the uniformly charged surface of the photosensitive drum 11 by light irradiation by the print head 13.

The development roller 14 is arranged to contact the surface of the photosensitive drum 11. The development roller 14, to which development voltage is applied, makes the developing agent adhere to the electrostatic latent image formed on the surface of the photosensitive drum 11. Consequently, a developing agent image is formed on the surface of the photosensitive drum 11.

The supply roller 15 is arranged to contact or face the surface of the development roller 14. The supply roller 15, to which supply voltage is applied, supplies the toner to the development roller 14. In each image forming unit 10, a part including the development roller 14 and the supply roller 15 is a part contributing to the development of the electrostatic latent image on the photosensitive drum 11 and constitutes a development unit.

A housing of the image forming apparatus 1 includes a basket frame 101 as a housing part that houses the image forming units 10K, 10C, 10M and 10Y, an openable and closable top cover 102 attached to the basket frame 101, and a base frame 103 that supports these components.

Over the image forming units 10K, 10C, 10M and 10Y, developing agent containers 200K, 200C, 200M and 200Y for respectively supplying the developing agents to the image forming units 10K, 10C, 10M and 10Y are provided in a detachable manner. The developing agent containers 200K, 200C, 200M and 200Y are attached to the top cover 102.

The developing agent containers 200K, 200C, 200M and 200Y respectively store the developing agents of black, cyan, magenta and yellow. Each developing agent container 200K, 200C, 200M, 200Y is referred to also as a "developing agent container 200".

The print head 13 includes, for example, a light-emitting device array formed by arraying light-emitting devices such as LEDs (Light-Emitting Diodes) and a lens array that condenses light emitted from the light-emitting devices on the surface of the photosensitive drum 11. The print head 13 is supplied with drive voltage based on print data, exposes the surface of the photosensitive drum 11 to light, and thereby forms the electrostatic latent image corresponding to the print data.

The transfer unit 80 includes a transfer belt 82 in an endless shape, a drive roller 83 and an idle roller 84 across which the transfer belt 82 is stretched, and transfer rollers 81K, 81Y, 81M and 81C arranged to respectively face the photosensitive drums 11 of the image forming units 10K, 10C, 10M and 10Y via the transfer belt 82.

The transfer belt 82 travels while attracting and holding the medium P on its surface by electrostatic force. The drive roller 83 is rotated by a belt motor (not shown) and makes the transfer belt 82 travel. The idle roller 84 gives tension to the transfer belt 82. Each transfer roller 81K, 81Y, 81M, 81C, to which transfer voltage is applied, transfers the developing agent image on the photosensitive drum 11 onto the medium P.

The fixation device 85 is arranged on a downstream side of the image forming section 100 in the conveyance path R2 of the medium P. The fixation device 85 includes, for example, a fixation roller 86 and a pressure roller 87 pressed against the fixation roller 86. The fixation roller 86 includes a built-in heater as a heat source and is rotated by a fixation motor. The fixation roller 86 and the pressure roller 87 fix the developing agent images on the medium P by applying heat and pressure to the developing agent images transferred onto the medium P.

Ejection roller pairs 77 and 78 are arranged on the downstream side of the fixation device 85 in a conveyance path R3 of the medium P. The ejection roller pairs 77 and 78 convey the medium P sent out from the fixation device 85 along the conveyance path R3 and eject the medium P to the outside of the image forming apparatus 1. The top cover of the image forming apparatus 1 includes a stacker part 79 in which the media P ejected by the ejection roller pairs 77 and 78 are stacked.

The image forming apparatus 1 includes a re-conveyance mechanism 90 that turns over the medium P on which the developing agent images have been fixed and conveys the medium P to the aforementioned conveyance roller pair 76 for double-side printing. Further, a switching guide 91 that guides the medium P sent out from the fixation device 85 to the ejection roller pairs 77 and 78 or to the re-conveyance mechanism 90 is provided on the downstream side of the fixation device 85.

The re-conveyance mechanism 90 includes conveyance roller pairs 92 and 94 and a switching guide 94 that temporarily sends the medium P into a turnout path R4 and turns the medium P to switch the front and rear ends with each other and conveyance roller pairs 95, 96 and 97 that convey the medium P along a return conveyance path R5. The medium P after being conveyed by the conveyance roller pairs 95 to 97 through the return conveyance path R5 is conveyed to the image forming section 100 via the conveyance roller pairs 75 and 76. Incidentally, the re-conveyance mechanism 90 is unnecessary in cases where the image forming apparatus 1 does not have the double-side printing function.

In FIG. 1, the moving direction of the medium P when the medium P passes through the image forming section 100 is defined as the +Y direction. Further, the width direction of the medium P conveyed in the +Y direction is an X direction. The X direction is parallel to rotary shafts of the photosensitive drums 11. A Z direction is a direction orthogonal to the X direction and the Y direction. While an XY plane as a plane containing the X direction and the Y direction is inclined with respect to the horizontal plane in FIG. 1, the XY plane may also be designed to be in parallel with the horizontal plane.

Figure 2:
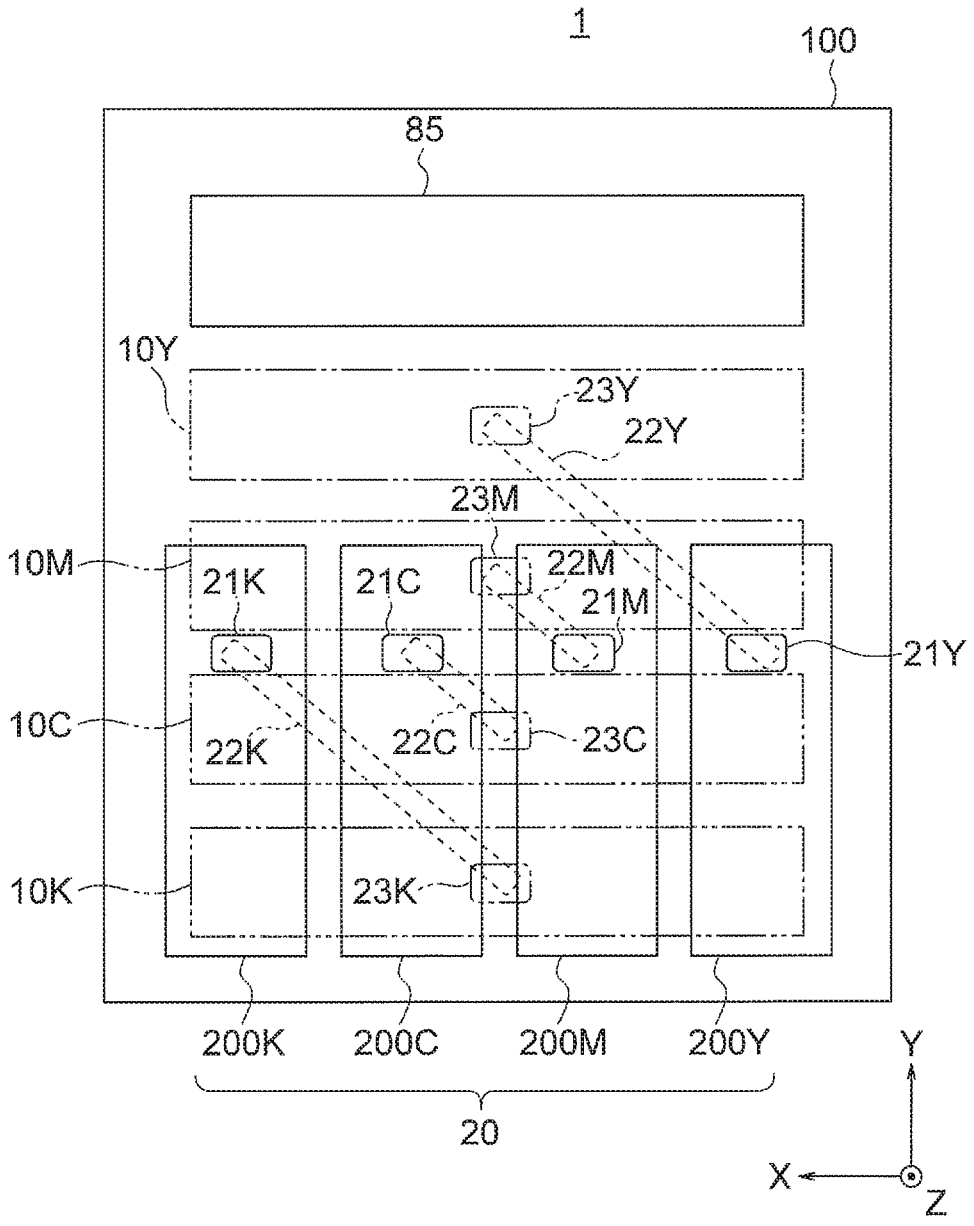
FIG. 2 is a plan view schematically showing arrangement of developing agent containers in the image forming apparatus according to the first embodiment.

FIG. 2 is a plan view schematically showing the arrangement of the developing agent containers 200K, 200C, 200M and 200Y in the image forming apparatus 1 according to the first embodiment. FIG. 2 shows positional relationship of the image forming units 10K, 10C, 10M and 10Y and the developing agent containers 200K, 200C, 200M and 200Y.

The image forming units 10K, 10C, 10M and 10Y, each of which is long-shaped in the X direction, are arranged in a line in the Y direction. On the other hand, the developing agent containers 200K, 200C, 200M and 200Y, each of which is long-shaped in the Y direction, are arranged in the X direction as a direction orthogonal to the arrangement direction of the image forming units 10K, 10C, 10M and 10Y.

Ducts 22K, 22C, 22M and 22Y as developing agent conveyance channels are respectively provided between the developing agent containers 200K, 200C, 200M and 200Y and the image forming units 10K, 10C, 10M and 10Y. Each duct 22K, 22C, 22M, 22Y has a coupling part 21K, 21C, 21M, 21Y coupled to the developing agent container 200K, 200C, 200M, 200Y and a connection part 23K, 23C, 23M, 23Y connected to the image forming unit 10K, 10C, 10M, 10Y.

In this example, the coupling parts 21K, 21C, 21M and 21Y are arranged at Y direction positions equal to each other. Further, the connection parts 23K, 23C, 23M and 23Y are arranged at X direction positions equal to each other. However, the arrangement of these parts is not limited to the example of FIG. 2. A developing agent supply unit 20 is formed by the developing agent containers 200K, 200C, 200M and 200Y and the ducts 22K, 22C, 22M and 22Y. The developing agent supply unit 20 is attached to the top cover 102. Incidentally, the developing agent supply unit is referred to also as a "toner supply unit". Each duct 22K, 22C, 22M, 22Y is referred to also as a "duct 22". Each coupling part 21K, 21C, 21M, 21Y is referred to also as a "coupling part 21". Each connection part 23K, 23C, 23M, 23Y is referred to also as a "connection part 23".

Figure 3A:
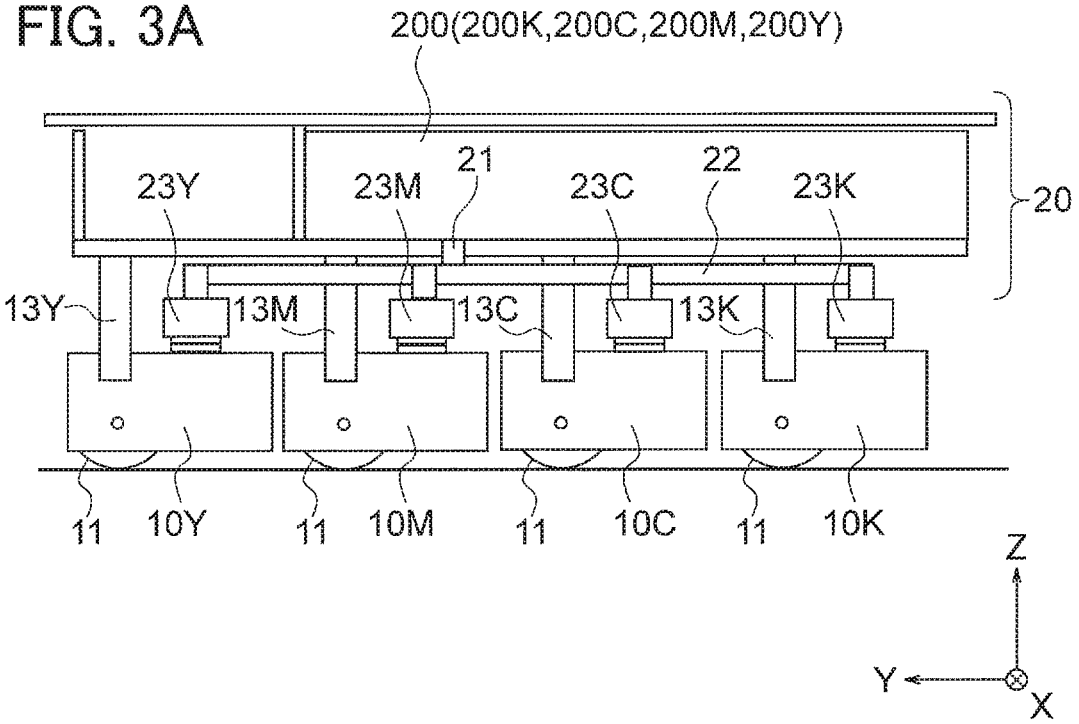
FIG. 3A is a side view schematically showing the developing agent containers, image forming units, and ducts connecting them to each other in the image forming apparatus according to the first embodiment.
Figure 3B:
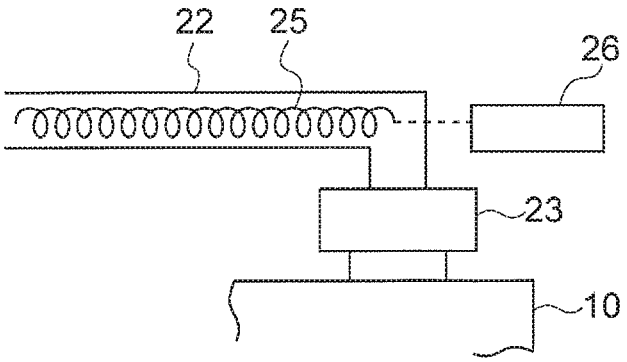
FIG. 3B is a diagram showing a conveyance spiral provided in the duct.

FIG. 3A is a side view schematically showing the developing agent containers 200, the image forming units 10K, 10C, 10M and 10Y, and the ducts 22 connecting them to each other in the image forming apparatus 1 according to the first embodiment, and FIG. 3B is a diagram showing a conveyance spiral 25 provided in the duct 22. While one duct 22 is shown in FIG. 3A, four ducts 22K, 22C, 22M and 22Y are actually provided as shown in FIG. 2.

The developing agent stored in the developing agent container 200 is supplied from the coupling part 21 to the inside of the duct 22 by means of dropping. Inside each duct 22, the conveyance spiral 25 as a conveyance member for conveying the developing agent is provided, and the conveyance spiral 25 conveys the developing agent from the coupling part 21 to the connection part 23 along the duct 22. The developing agent conveyed to the connection part 23 through the duct 22 is supplied to the image forming unit 10 by means of dropping.

As shown in FIG. 3B, the conveyance spiral 25 is arranged substantially throughout the whole range of the duct 22 in its lengthwise direction and rotates around a rotation axis extending in the lengthwise direction of the duct 22. The conveyance spiral 25 is driven by a developing agent supply motor 26. The developing agent supply motor 26 is provided for each conveyance spiral 25. However, it is also possible to transmit driving force of a common developing agent supply motor 26 to each conveyance spiral 25 via a power transmission mechanism such as a clutch.

Figure 4:
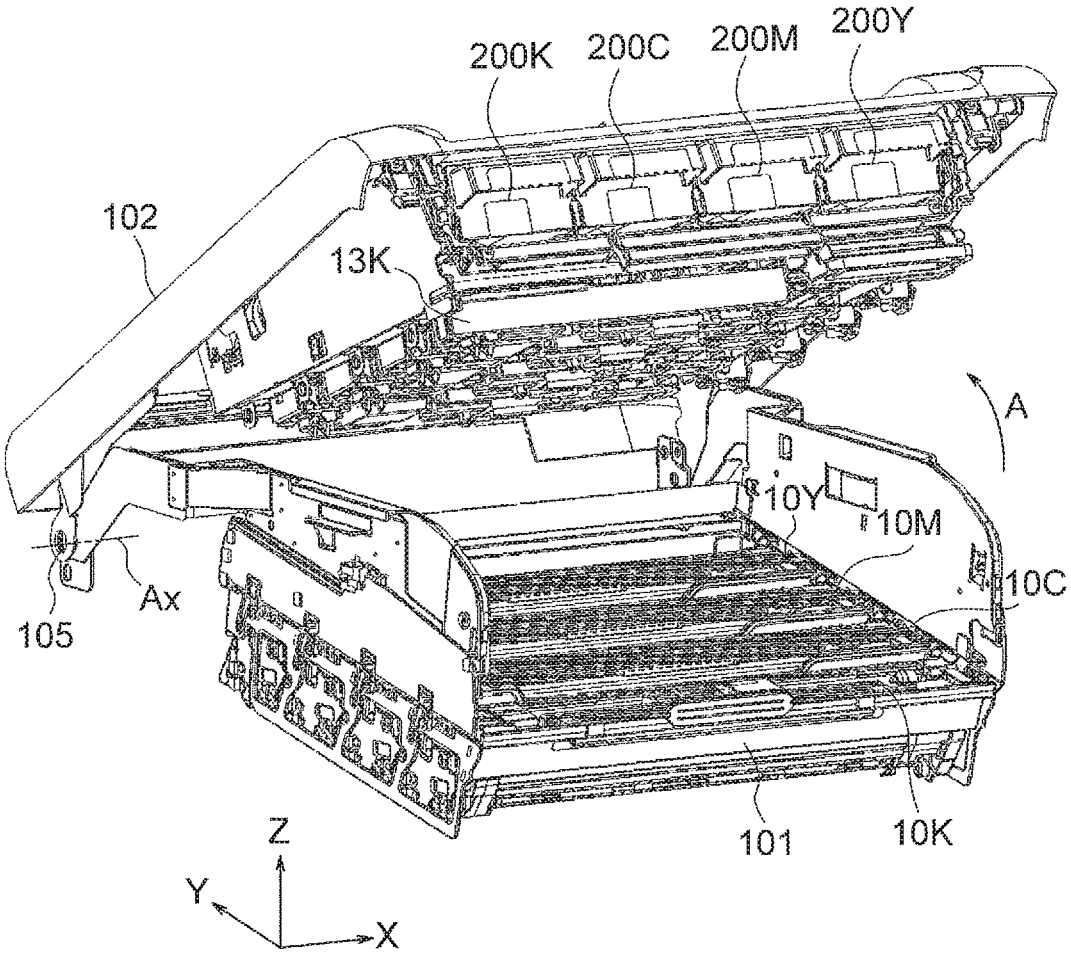
FIG. 4 is a perspective view showing a state of the image forming apparatus according to the first embodiment in which a top cover is open.

FIG. 4 is a perspective view showing a state of the image forming apparatus 1 according to the first embodiment in which the top cover 102 is open. The top cover 102 is pivotably supported by a pivot shaft 105 provided in the vicinity of an end of the basket frame 101 in the +Y direction. The axial direction of the pivot shaft 105 is the X direction. The top cover 102 can be opened as indicated by the arrow A by pivoting the top cover 102 around the pivot shaft 105.

As described above, the developing agent supply unit 20 including the developing agent containers 200K, 200C, 200M and 200Y and the ducts 22K, 22C, 22M and 22Y is supported by the top cover 102. Thus, when the top cover 102 is opened, the developing agent supply unit 20 also pivots in an opening direction as the direction indicated by the arrow A. The replacement of the developing agent container 200 is made with the top cover 102 open, in which case the coupling between the coupling part 21 and the developing agent container 200 is released.

In the first embodiment, the developing agent containers 200 and the image forming unit 10 are connected to each other by the ducts 22. However, it is also possible to employ a configuration in which the developing agent containers 200 are directly attached to the image forming unit 10 without using the ducts 22.

Further, while the arrangement direction of the image forming units 10K, 10C, 10M and 10Y and the arrangement direction of the developing agent containers 200K, 200C, 200M and 200Y are orthogonal to each other in FIGS. 1 to 4, these arrangement directions may also be parallel to each other.

(1-2) Developing Agent Container

Figure 5:
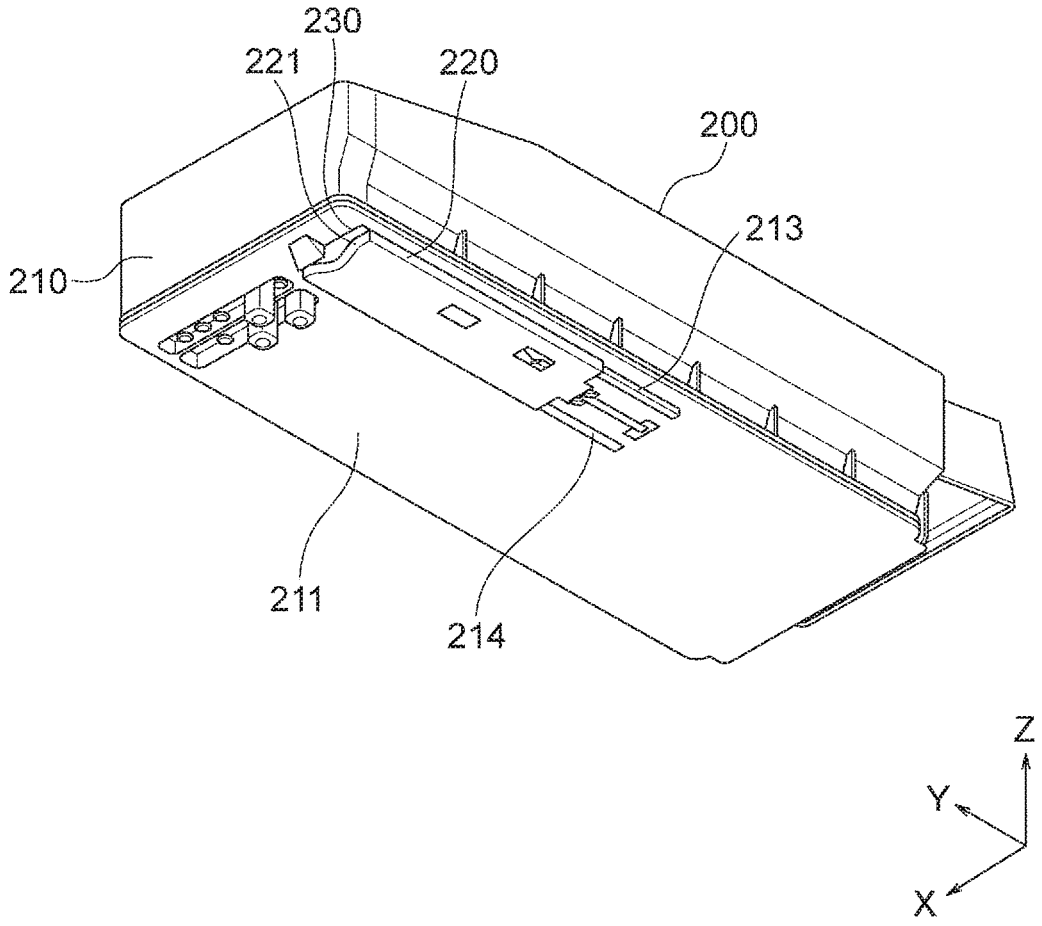
FIG. 5 is an external perspective view schematically showing the structure of the developing agent container according to the first embodiment.
Figure 6A:
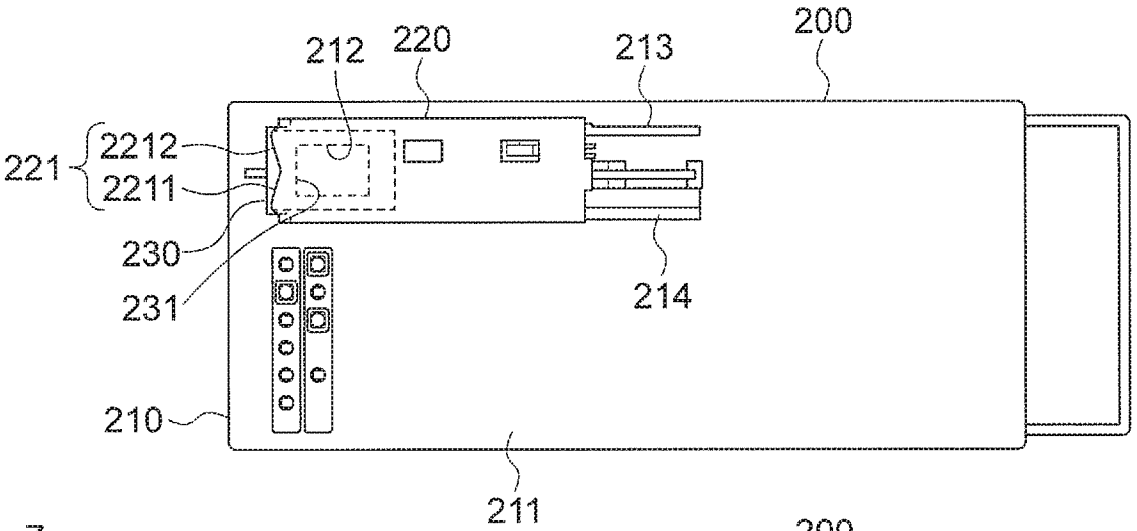
FIGS. 6A and 6B are bottom views schematically showing the structure of an under surface of the developing agent container according to the first embodiment.
Figure 6B:
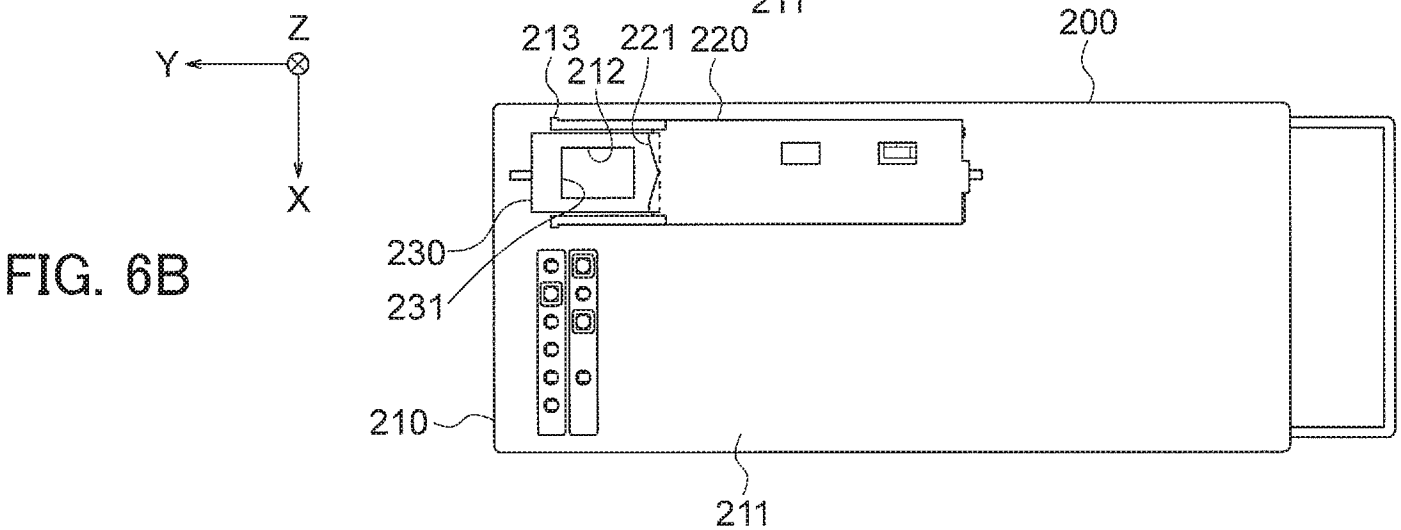

FIG. 5 is an external perspective view schematically showing the structure of the developing agent container 200 according to the first embodiment. FIGS. 6A and 6B are bottom views schematically showing the structure of an under surface 211 of a container 210 of the developing agent container 200. The developing agent container 200 includes the container 210 having the under surface 211 as a first surface having a supply hole 212 for the developing agent, a shutter 220 in a plate-like shape, and a seal sponge 230 that deforms elastically. In the first embodiment, one developing agent container 200 stores one type of developing agent.

The container 210, storing the developing agent, has the under surface 211. The supply hole 212 as an opening is formed through the under surface 211. Further, the under surface 211 of the container 210 includes guide rails 213 and 214 for guiding the shutter 220 in the +Y direction as a first direction and in the −Y direction as a direction opposite to the +Y direction.

The shutter 220 is provided on the container 210 to be slidable along the guide rails 213 and 214. The shutter 220 reaches a closed position, for setting the supply hole 212 to a closed state, by moving in the +Y direction as a direction along the under surface 211. FIG. 5 and FIG. 6A show a case where the supply hole 212 is in the closed state. The shutter 220 reaches an open position, for setting the supply hole 212 to an open state, by moving in the −Y direction. FIG. 6B shows a case where the supply hole 212 is in the open state.

The seal sponge 230 is stuck to a region of the under surface 211 of the container 210 surrounding the supply hole 212. Namely, an opening in the same shape as the supply hole 212 is formed at the center of the seal sponge 230. When the supply hole 212 is in the closed state by the shutter 220, the seal sponge 230 is compressed between the under surface 211 and the shutter 220 and seals a gap between the under surface 211 and the shutter 220. When the supply hole 212 is in the closed state by the shutter 220, the developing agent stored in the container 210 does not leak to the outside thanks to the seal sponge 230.

Incidentally, the thickness of the seal sponge 230 is 3.085 mm and the compression amount of the seal sponge 230 due to the pressing by the shutter 220 is 0.735 mm, for example. A range of a satisfactory compression amount with respect to the thickness of the seal sponge 230 is desired to be within a range of 20% to 30% of the thickness of the seal sponge. The reason for the lower limit value is that there is the danger of insufficiency of sealability and leakage of the developing agent when the compression amount is less than 20%. The reason for the upper limit value is that the danger of the curling, tearing or the like of the seal sponge 230 increases when the compression amount exceeds 30%. The shutter 220 is 0.3 mm thick and made of metal, for example. However, the dimensions of the parts are not limited to the above-described values.

Further, in the example of FIG. 5, FIG. 6A and FIG. 6B, the shutter 220 and the seal sponge 230 are configured so that a ridge line (referred to also as a "first ridge line part") of an edge part (referred to also as a "first edge part") 221 of the shutter 220 facing the +Y direction is inclined with respect to a ridge line (referred to also as a "second ridge line part") of an edge part (referred to also as a "second edge part") 231 of the seal sponge 230 facing the supply hole 212 and the −Y direction. Put another way, the shutter 220 has the first ridge line part that makes contact with the seal sponge 230 due to the movement of the shutter 220, in the edge part 221 on the front end side in the +Y direction, the seal sponge 230 has the second ridge line part that makes contact with the shutter 220 due to the movement of the shutter 220 in the +Y direction, in the edge part 231 on the −Y direction side facing the supply hole 212, and the first ridge line part and the second ridge line part have a relationship in which one is inclined with respect to the other. Specifically, the ridge line of the edge part 231 of the seal sponge 230 is a straight line in the X direction as a second direction orthogonal to the Y direction, and the ridge line of the edge part 221 of the shutter 220 includes a first part 2211 inclined with respect to the X direction and a second part 2212 inclined with respect to both of the X direction and the first part 2211.

In the example of FIG. 5, FIG. 6A and FIG. 6B, the shape of the edge part 221 of the shutter 220 viewed in the Z direction as a third direction orthogonal to both of the Y direction and the X direction is a V-shape. In other words, the first part 2211 and the second part 2212 gradually project in the +Y direction with the increase in the distance from a central position of the shutter 220 in the X direction.

FIGS. 7A, 7C, 7E, 7G and 7I are bottom views showing a closing operation of the supply hole 212 of the developing agent container 200 according to the first embodiment, and FIGS. 7B, 7D, 7F, 7H and 7J are cross-sectional views showing the closing operation of the supply hole 212 of the developing agent container 200. FIGS. 7B, 7D, 7F, 7H and 7J respectively show cross sections intersecting with FIGS. 7A, 7C, 7E, 7G and 7I at the position of the line S7-S7 shown in FIG. 7A.

In the closing operation of the shutter 220, the shutter 220 moves from the open state shown in FIGS. 7A and 7B in the +Y direction successively as shown in FIGS. 7C and 7D, FIGS. 7E and 7F and FIGS. 7G and 7H and finally shifts to the closed state shown in FIGS. 7I and 7J. In contrast, in the opening operation of the shutter 220, the shutter 220 moves from the closed state shown in FIGS. 7I and 7J in the −Y direction successively as shown in FIGS. 7G and 7H, FIGS. 7E and 7F and FIGS. 7C and 7D and finally shifts to the open state shown in FIGS. 7A and 7B.

Figures 8A, 8B, 8C, 8D, 8E, 8F, 8G, 8H, 8I, 8J, 8K:
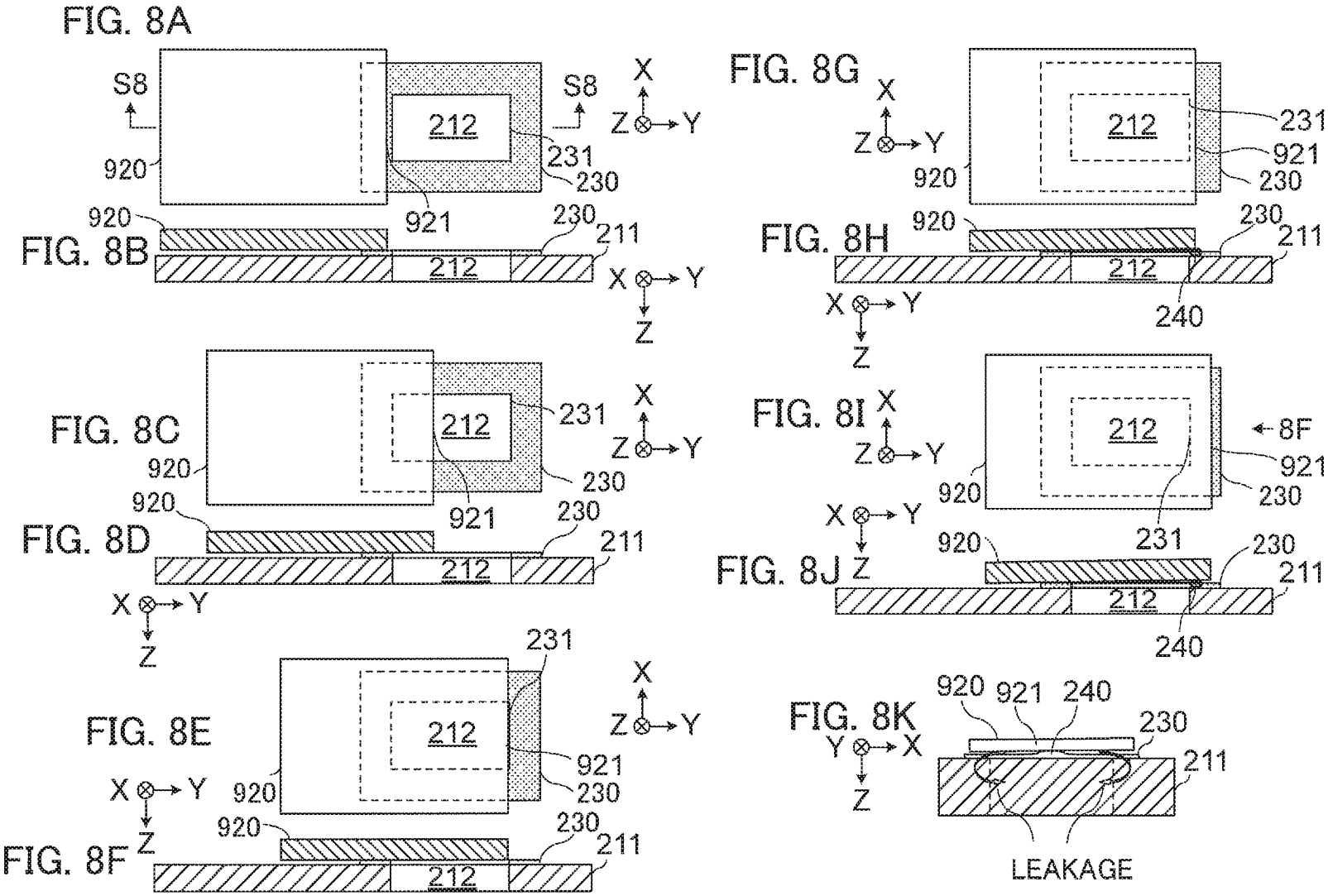
FIGS. 8A, 8C, 8E, 8G and 8I are bottom views showing the closing operation of a supply hole of a developing agent container as a comparative example.
FIGS. 8B, 8D, 8F, 8H and 8J are cross-sectional views showing the closing operation of the supply hole of the developing agent container as the comparative example.
FIG. 8K is a diagram showing a state in which the developing agent container in FIG. 8I is viewed in the direction of the arrow 8F.

FIGS. 8A, 8C, 8E, 8G and 8I are bottom views showing the closing operation of a supply hole of a developing agent container as a comparative example, FIGS. 8B, 8D, 8F, 8H and 8J are cross-sectional views showing the closing operation of the supply hole of the developing agent container as the comparative example, and FIG. 8K is a diagram showing a state in which the developing agent container in FIG. 8I is viewed in the direction of the arrow 8F. FIGS. 8B, 8D, 8F, 8H and 8J respectively show cross sections intersecting with FIGS. 8A, 8C, 8E, 8G and 8I at the position of the line S8-S8 shown in FIG. 8A. The developing agent container as the comparative example differs from the developing agent container shown in FIGS. 7A, 7C, 7E, 7G and 7I and FIGS. 7B, 7D, 7F, 7H and 7J in the shape of a shutter 920. In the developing agent container as the comparative example, the shutter 920 and the seal sponge 230 are configured so that a ridge line of an edge part 921 of the shutter 920 facing the +Y direction is parallel to the ridge line of the edge part 231 of the seal sponge 230 facing the supply hole 212 and the −Y direction.

In the closing operation of the shutter 920, the shutter 920 moves from the open state shown in FIGS. 8A and 8B in the +Y direction successively as shown in FIGS. 8C and 8D, FIGS. 8E and 8F and FIGS. 8G and 8H and finally shifts to the closed state shown in FIGS. 8I, 8J and 8K. In the comparative example, however, in the middle of moving the shutter 920 situated at the open position to the closed position, the whole region of the edge part 921 of the shutter 920 facing the +Y direction simultaneously makes contact with the whole region of the edge part 231 of the seal sponge 230 facing the supply hole 212 and the −Y direction as shown in FIGS. 8E and 8F. At that time, a situation occurs in which the whole region of the edge part 921 of the shutter 920 simultaneously applies force to the whole region of the edge part 231 of the seal sponge 230. Thus, the curling can occur to the edge part 231 of the seal sponge 230. In this case, as shown in FIGS. 8H, 8J and 8K, a part of the seal sponge 230 in the vicinity of the edge part 231 peels off the under surface 211, becomes pressed in the +Y direction, and forms a part 240 having an increased thickness. When the curling occurs to the edge part 231 of the seal sponge 230, the sealing of the gap between the under surface 211 of the container and the shutter 920 by the seal sponge 230 becomes imperfect as shown in FIG. 8K and the developing agent can leak out even though the shutter 920 is at the closed position.

In contrast, in the first embodiment, in the middle of moving the shutter 220 situated at the open position to the closed position, the edge part 221 of the shutter 220 facing the +Y direction is inclined with respect to the edge part 231 of the seal sponge 230 facing the supply hole 212 and the −Y direction as shown in FIGS. 7E and 7F. In this case, as shown in FIGS. 7E and 7F and FIGS. 7G and 7H, there occurs no situation in which the whole region of the edge part 221 of the shutter 220 facing the +Y direction simultaneously makes contact with the whole region of the edge part 231 of the seal sponge 230. Accordingly, there occurs no situation in which the whole region of the edge part 221 of the shutter 220 simultaneously applies strong force to the whole region of the edge part 231 of the seal sponge 230. Thus, the curling hardly occurs to the edge part 231 of the seal sponge 230.

As described above, with the developing agent container 200 according to the first embodiment, the curling hardly occurs to the edge part of the seal sponge 230, and thus an advantage is obtained in that the leakage of the developing agent due to the curling of the seal sponge 230 hardly occurs.

Further, in the developing agent container 200 according to the first embodiment, the outer shape of the seal sponge 230 is a rectangular shape and the shape of the opening of the seal sponge 230 is also a rectangular shape, and thus the length in the Y direction is relatively short and that is suitable for the downsizing of the developing agent container 200. In addition, the shape of the seal sponge 230 is simple and the processing cost can be cut down.

Furthermore, in the developing agent container 200 according to the first embodiment, the edge part 221 of the shutter 220 is in a V-shape, and thus the developing agent moves along the edge part 221 towards the central position in the X direction when the edge part 221 moves in the +Y direction, by which scattering of the developing agent accompanying the closing operation of the shutter 220 can be reduced.

(1-3) First Modification

Figure 9A:
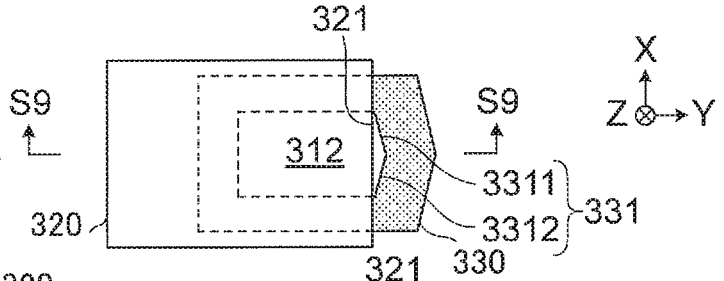
FIGS. 9A and 9C are bottom views showing the closing operation of a supply hole of a developing agent container according to a first modification of the first embodiment.
Figure 9B:
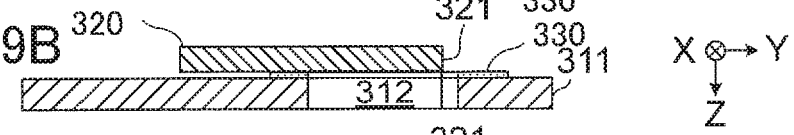
FIGS. 9B and 9D are cross-sectional views showing the closing operation of the supply hole of the developing agent container according to the first modification of the first embodiment.
Figure 9C:
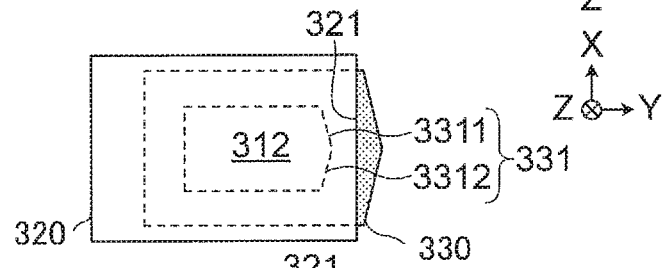
Figure 9D:
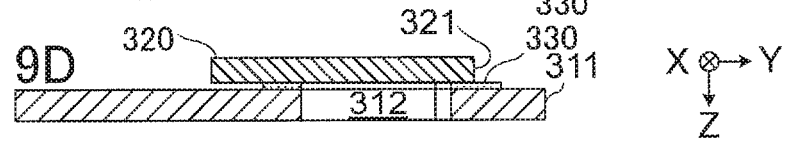

FIGS. 9A and 9C are bottom views showing the closing operation of a supply hole 312 of a developing agent container according to a first modification of the first embodiment, and FIGS. 9B and 9D are cross-sectional views showing the closing operation of the supply hole 312 of the developing agent container according to the first modification. FIGS. 9B and 9D respectively show cross sections intersecting with FIGS. 9A and 9C at the position of the line S9-S9 shown in FIG. 9A.

A ridge line of an edge part (second edge part) 331 of a seal sponge 330 includes a third part 3311 inclined with respect to the X direction orthogonal to the Y direction and a fourth part 3312 inclined with respect to both of the X direction and the third part 3311. A ridge line of an edge part (first edge part) 321 of a shutter 320 is a straight line in the X direction.

In the first modification, in the middle of moving the shutter 320 situated at the open position to the closed position, the ridge line (referred to also as a "first ridge line part") of the edge part 321 of the shutter 320 facing the +Y direction is inclined with respect to the ridge line (referred to also as a "second ridge line part") of the edge part 331 of the seal sponge 330 facing the supply hole 312 and the −Y direction as shown in FIGS. 9A and 9B. Put another way, the shutter 320 has the first ridge line part that makes contact with the seal sponge 330 due to the movement of the shutter 320, in the edge part 321 on the front end side in the +Y direction, the seal sponge 330 has the second ridge line part that makes contact with the shutter 320 due to the movement of the shutter 320 in the +Y direction, in the edge part 331 on the −Y direction side facing the supply hole 312, and the first ridge line part and the second ridge line part have the relationship in which one is inclined with respect to the other. In this case, as shown in FIGS. 9A and 9B, there occurs no situation in which the whole region of the edge part 321 of the shutter 320 facing the +Y direction simultaneously makes contact with the whole region of the edge of the edge part 331 of the seal sponge 330. Accordingly, there occurs no situation in which the whole region of the edge part 321 of the shutter 320 simultaneously applies strong force to the whole region of the edge part 331 of the seal sponge 330. Thus, the curling hardly occurs to the edge part 331 of the seal sponge 330.

Further, in the developing agent container according to the first modification, the shutter 320 is in a rectangular shape, and thus the shape is simple and the processing cost can be cut down.

Furthermore, in the developing agent container according to the first modification, the edge part 331 of the seal sponge 330 is in a V-shape, and thus the developing agent moves along the edge part 331 towards the central position in the X direction when the shutter 320 moves in the +Y direction, by which the scattering of the developing agent accompanying the closing operation of the shutter 320 can be reduced.

(1-4) Second Modification

Figure 10A:
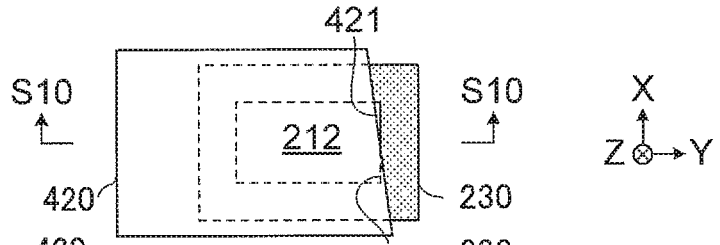
FIGS. 10A and 10C are bottom views showing the closing operation of the supply hole of a developing agent container according to a second modification of the first embodiment.
Figure 10B:
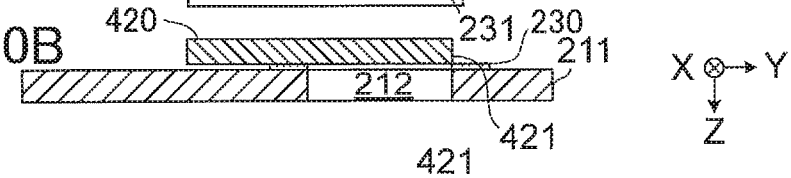
FIGS. 10B and 10D are cross-sectional views showing the closing operation of the supply hole of the developing agent container according to the second modification of the first embodiment.
Figure 10C:
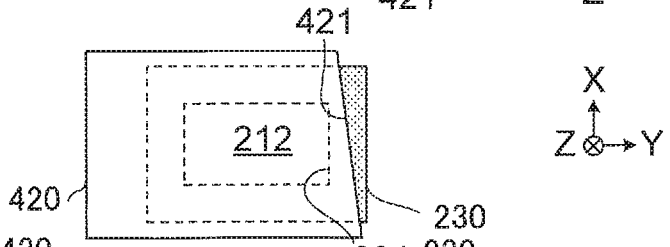
Figure 10D:
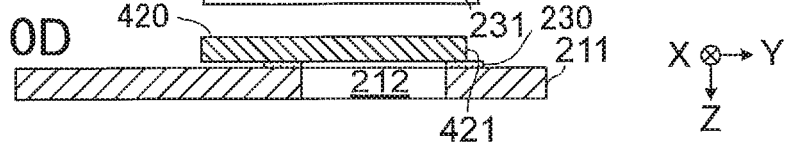

FIGS. 10A and 10C are bottom views showing the closing operation of the supply hole 212 of a developing agent container according to a second modification of the first embodiment, and FIGS. 10B and 10D are cross-sectional views showing the closing operation of the supply hole 212 of the developing agent container according to the second modification. FIGS. 10B and 10D respectively show cross sections intersecting with FIGS. 10A and 10C at the position of the line S10-S10 shown in FIG. 10A.

The ridge line of the edge part (second edge part) 231 of the seal sponge 230 is a straight line in the X direction orthogonal to the Y direction, and a ridge line of an edge part (first edge part) 421 of a shutter 420 is a straight line inclined with respect to the X direction.

In the second modification, in the middle of moving the shutter 420 situated at the open position to the closed position, the ridge line (referred to also as a "first ridge line part") of the edge part 421 of the shutter 420 facing the +Y direction is inclined with respect to the ridge line (referred to also as a "second ridge line part") of the edge part 231 of the seal sponge 230 facing the supply hole 212 and the −Y direction as shown in FIGS. 10A and 10B. Put another way, the shutter 420 has the first ridge line part that makes contact with the seal sponge 230 due to the movement of the shutter 420, in the edge part 421 on the front end side in the +Y direction, the seal sponge 230 has the second ridge line part that makes contact with the shutter 420 due to the movement of the shutter 420 in the +Y direction, in the edge part 231 on the −Y direction side facing the supply hole 212, and the first ridge line part and the second ridge line part have the relationship in which one is inclined with respect to the other. In this case, as shown in FIGS. 10A and 10B, there occurs no situation in which the whole region of the edge part 421 of the shutter 420 facing the +Y direction simultaneously makes contact with the whole region of the edge of the edge part 231 of the seal sponge 230. Accordingly, there occurs no situation in which the whole region of the edge part 421 of the shutter 420 simultaneously applies strong force to the whole region of the edge part 231 of the seal sponge 230. Thus, the curling hardly occurs to the edge part 231 of the seal sponge 230.

(1-5) Third Modification

Figure 11A:
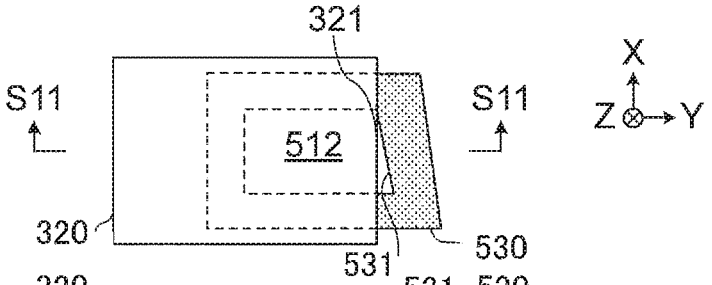
FIGS. 11A and 11C are bottom views showing the closing operation of a supply hole of a developing agent container according to a third modification of the first embodiment.
Figure 11B:
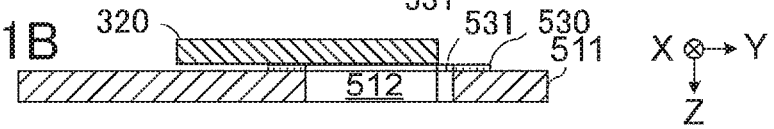
FIGS. 11B and 11D are cross-sectional views showing the closing operation of the supply hole of the developing agent container according to the third modification of the first embodiment.
Figure 11C:
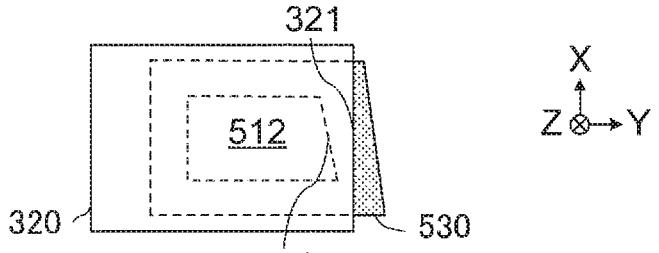
Figure 11D:
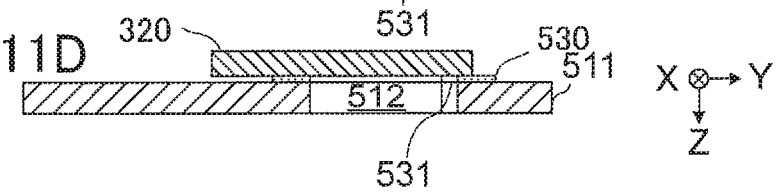

FIGS. 11A and 11C are bottom views showing the closing operation of a supply hole 512 of a developing agent container according to a third modification of the first embodiment, and FIGS. 11B and 11D are cross-sectional views showing the closing operation of the supply hole 512 of the developing agent container according to the third modification. FIGS. 11B and 11D respectively show cross sections intersecting with FIGS. 11A and 11C at the position of the line S11-S11 shown in FIG. 11A.

A ridge line of a second edge part 531 of a seal sponge 530 is a straight line inclined with respect to the X direction orthogonal to the Y direction, and the ridge line of the first edge part 321 of the shutter 320 is a straight line in the X direction.

In the third modification, in the middle of moving the shutter 320 situated at the open position to the closed position, the ridge line (referred to also as a "first ridge line part") of the edge part (first edge part) 321 of the shutter 320 facing the +Y direction is inclined with respect to the ridge line (referred to also as a "second ridge line part") of the edge part (second edge part) 531 of the seal sponge 530 facing the supply hole 512 and the −Y direction as shown in FIGS. 11A and 11B. Put another way, the shutter 320 has the first ridge line part that makes contact with the seal sponge 530 due to the movement of the shutter 320, in the edge part 321 on the front end side in the +Y direction, the seal sponge 530 has the second ridge line part that makes contact with the shutter 320 due to the movement of the shutter 320 in the +Y direction, in the edge part 531 on the −Y direction side facing the supply hole 512, and the first ridge line part and the second ridge line part have the relationship in which one is inclined with respect to the other. In this case, as shown in FIGS. 11A and 11B, there occurs no situation in which the whole region of the edge part 321 of the shutter 320 facing the +Y direction simultaneously makes contact with the whole region of the edge of the edge part 531 of the seal sponge 530. Accordingly, there occurs no situation in which the whole region of the edge part 321 of the shutter 320 simultaneously applies strong force to the whole region of the edge part 531 of the seal sponge 530. Thus, the curling hardly occurs to the edge part 531 of the seal sponge 530.

(2) Second Embodiment

Figure 12:
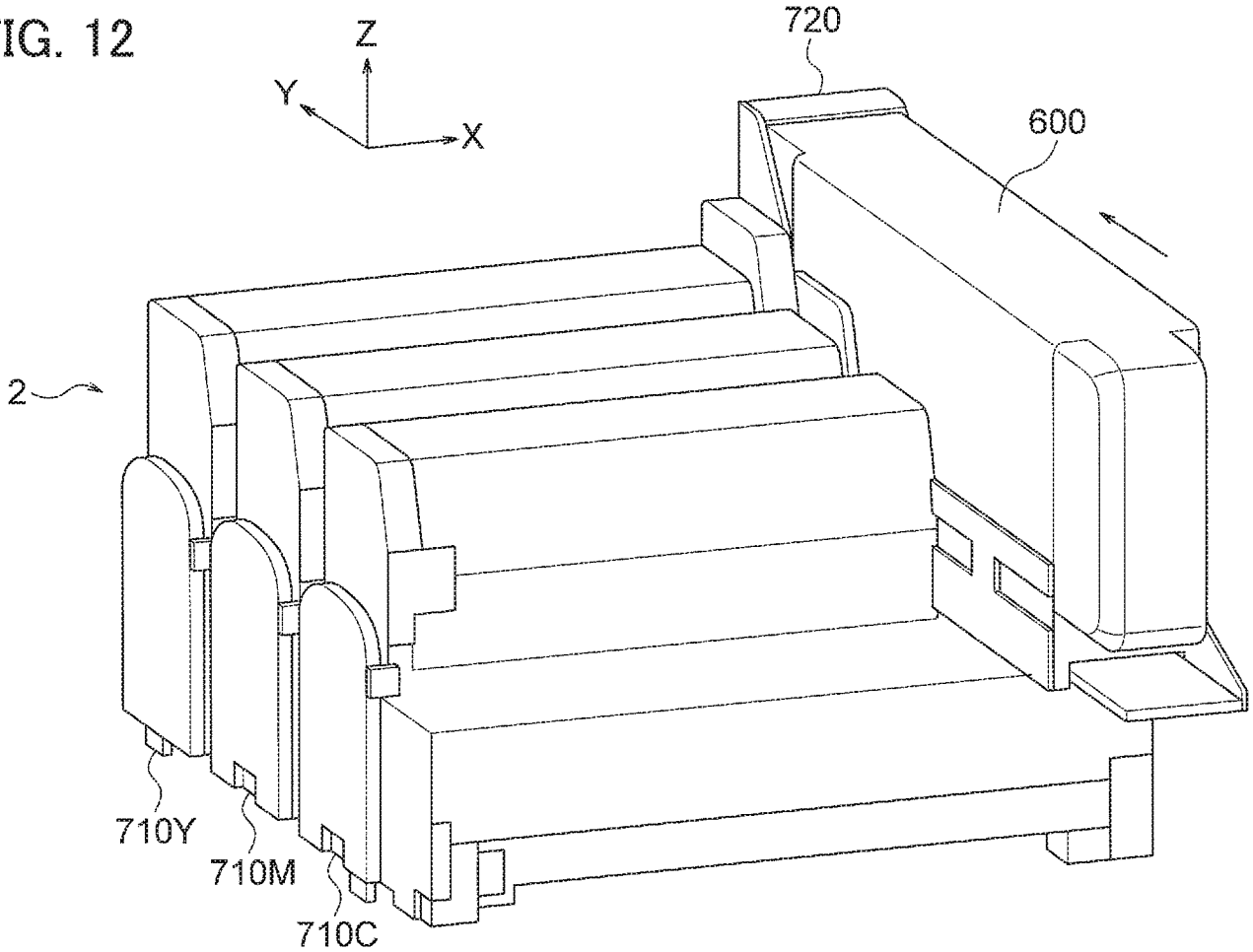
FIG. 12 is a perspective view schematically showing internal structure of an image forming apparatus according to a second embodiment of the present invention.

FIG. 12 is a perspective view schematically showing internal structure of an image forming apparatus 2 according to a second embodiment. As shown in FIG. 12, the image forming apparatus 2 includes image forming units 710Y, 710M and 710C that form developing agent images by using the electrophotographic method, a stage 720 as an attachment part to which a developing agent container 600 is attached, and the developing agent container 600. In the second embodiment, one developing agent container 600 stores three types of developing agents. However, the types of the developing agents stored in one developing agent container are not limited to three types.

The image forming units 710Y, 710M and 710C form developing agent images of yellow, magenta and cyan. The image forming units 710Y, 710M and 710C are arranged side by side in the Y direction as a medium conveyance direction. Internal structure of each image forming unit 710Y, 710M, 710C is similar to that of each image forming unit 10Y, 10M, 10C shown in FIG. 1.

The stage 720 is provided on one side of the image forming units 710Y, 710M and 710C at one end in the X direction orthogonal to the Y direction as the medium conveyance direction. The developing agent container 600 is attached to the stage 720 in a detachable manner.

The developing agent container 600 includes three developing agent container parts 640Y, 640M and 640C in a container 610. The developing agent container parts 640Y, 640M and 640C respectively store developing agents of yellow, magenta and cyan. By attaching the developing agent container 600 to the stage 720, a supply hole shifts from the closed state to the open state and the yellow, magenta and cyan developing agents stored in the developing agent container 600 are respectively supplied to the image forming units 710Y, 710M and 710C.

Figure 13:
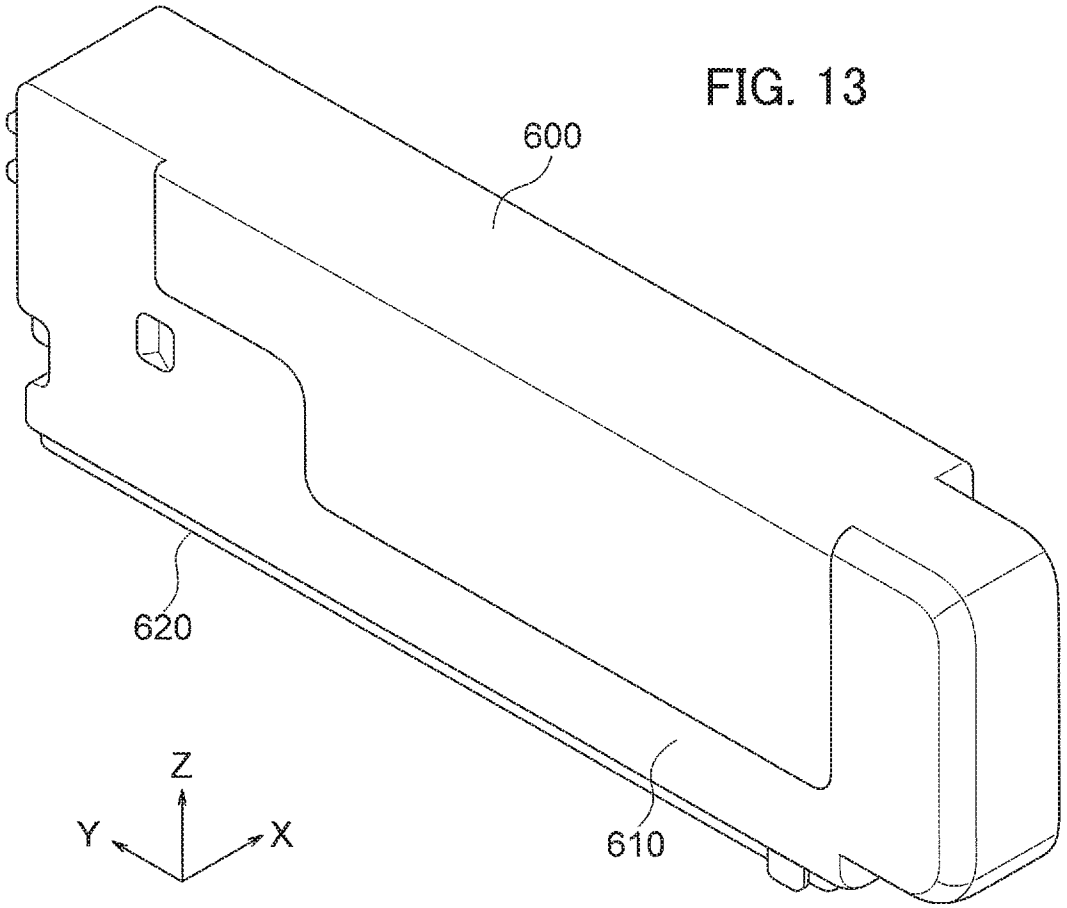
FIG. 13 is an external perspective view schematically showing a developing agent container according to the second embodiment.
Figure 14:
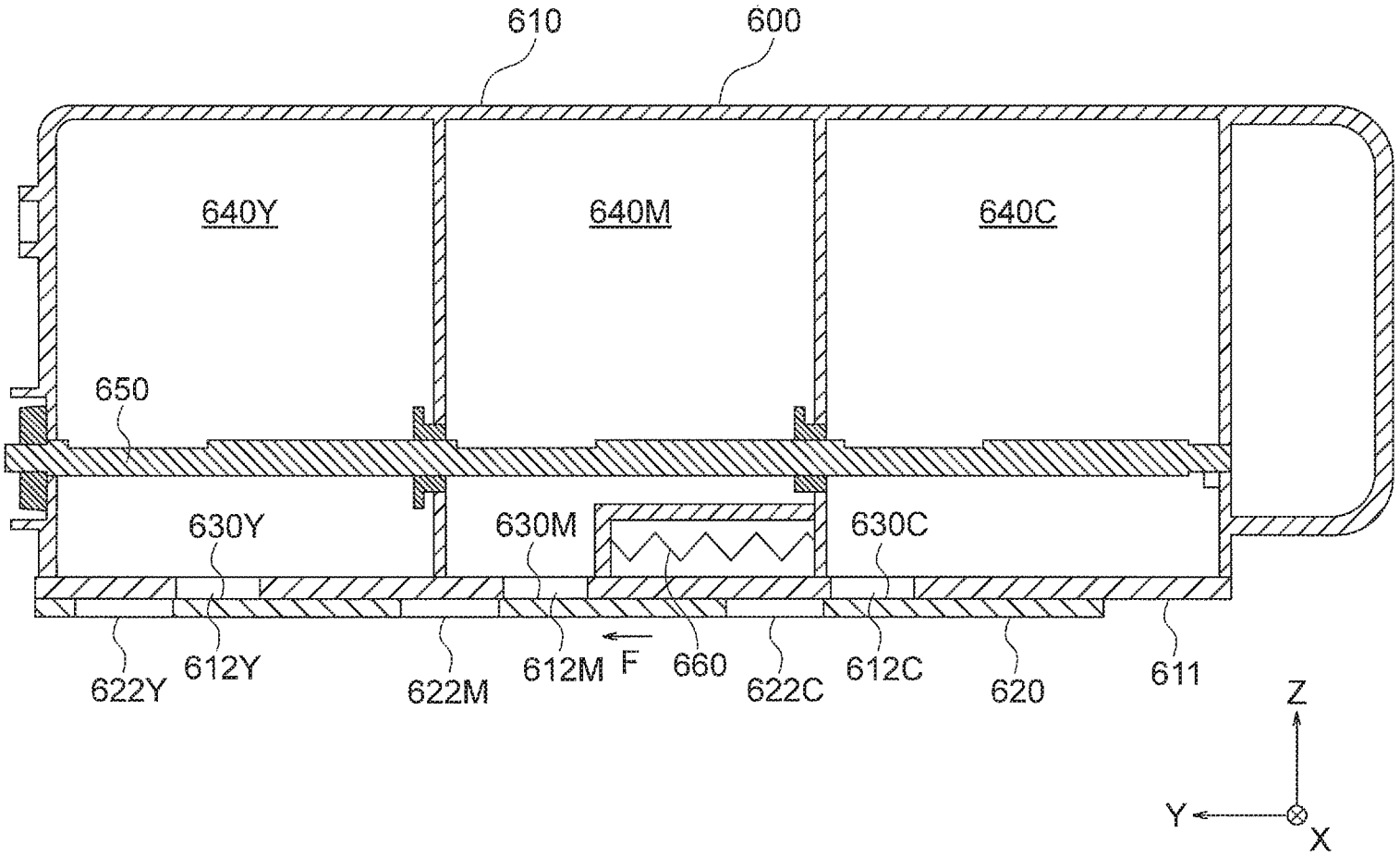
FIG. 14 is a schematic cross-sectional view showing the developing agent container according to the second embodiment.
Figure 15:
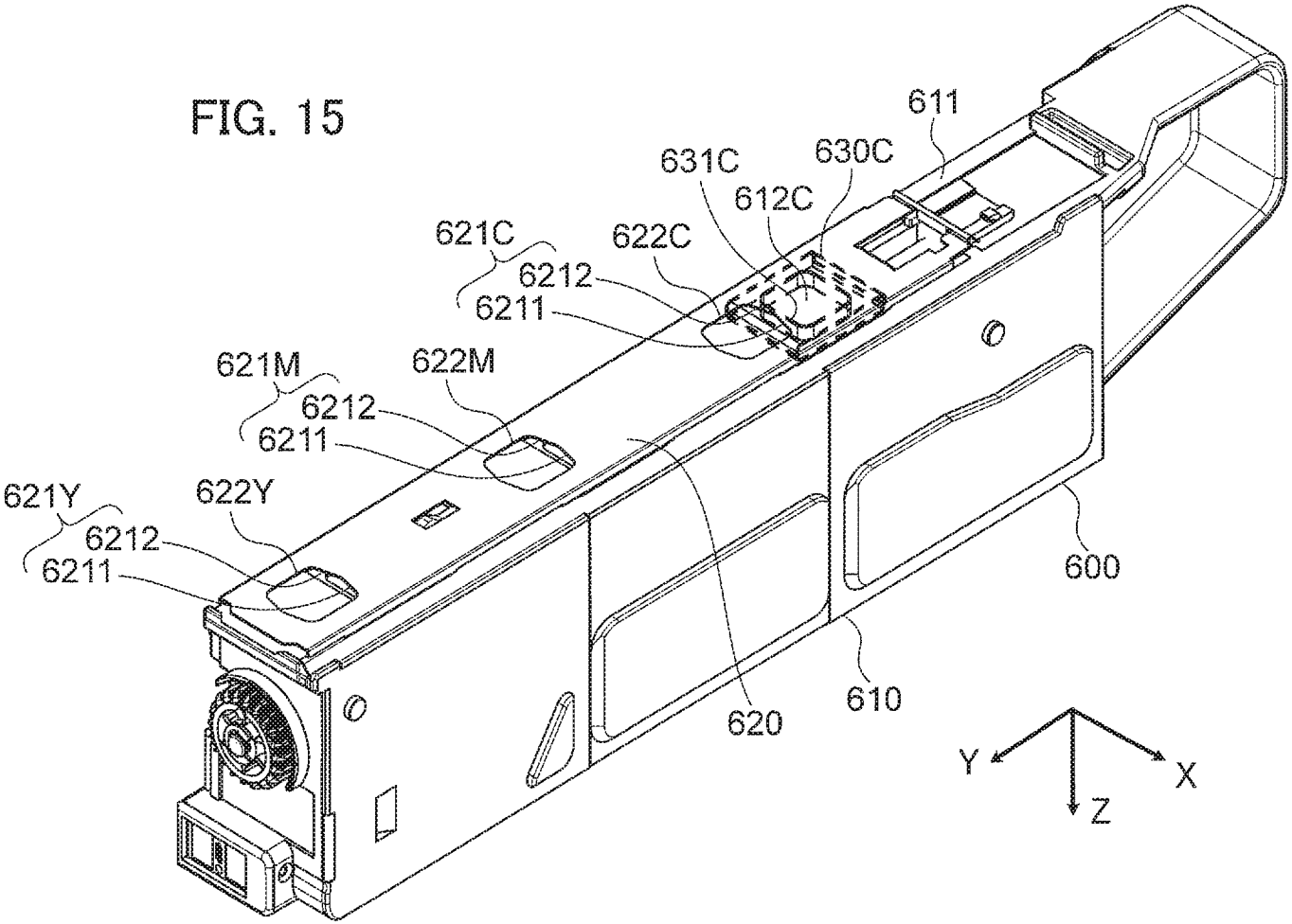
FIG. 15 is an external perspective view schematically showing the structure of the developing agent container according to the second embodiment.

FIG. 13 is an external perspective view schematically showing the developing agent container 600. FIG. 14 is a schematic cross-sectional view showing the developing agent container 600. FIG. 15 is an external perspective view schematically showing the structure of the developing agent container according to the second embodiment. The developing agent container 600 includes the container 610 having an under surface 611 as a first surface having supply holes 612Y, 612M and 612C for the developing agents, a shutter 620, and seal sponges 630Y, 630M and 630C.

Figure 16:
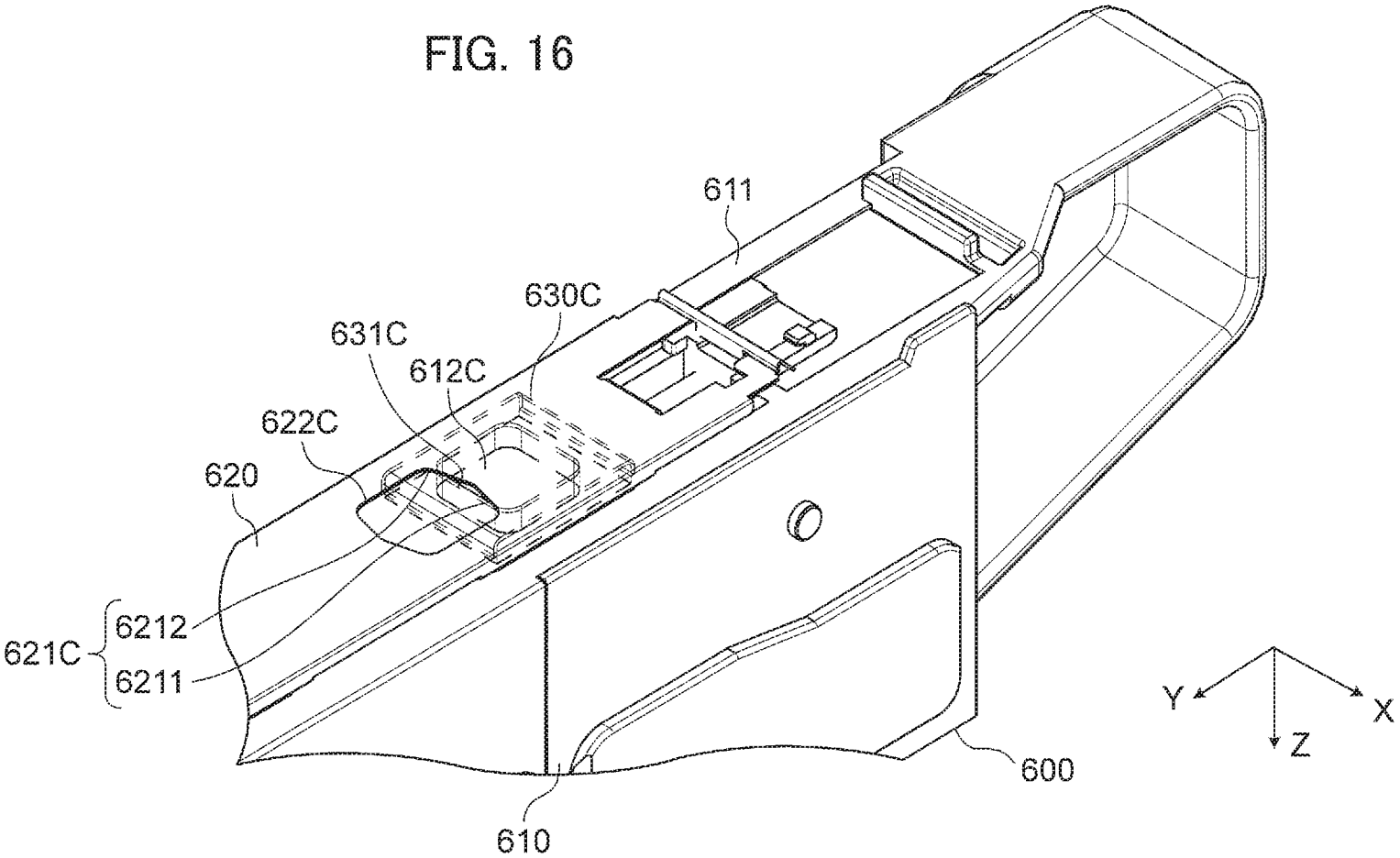
FIG. 16 is a perspective view showing a state of the developing agent container according to the second embodiment in the middle of a closing operation of a shutter.

The developing agent container parts 640Y, 640M and 640C of the container 610, storing the developing agents, have the under surface 611. The supply holes 612Y, 612M and 612C as openings are formed through the under surface 611. Further, the under surface 611 of the container 610 includes guide rails for guiding the shutter 620 in the +Y direction as the first direction and the −Y direction as the direction opposite to the +Y direction. As shown in FIGS. 14 and 16, the shutter 620 has openings 622Y, 622M and 622C that overlap with the supply holes 612Y, 612M and 612C when the shutter 620 is at the open position.

The shutter 620 as a plate-shaped member is provided on the container 610 to be slidable in the +Y direction and the −Y direction. The shutter 620 sets the supply holes 612Y, 612M and 612C to the closed state by moving in the +Y direction as a direction along the under surface 611. FIGS. 14 and 15 show a case where the supply holes 612Y, 612M and 612C are in the closed state. The shutter 620 sets the supply holes 612Y, 612M and 612C to the open state by moving in the −Y direction.

The seal sponges 630Y, 630M and 630C are stuck to regions of the under surface 611 of the container 610 surrounding the supply holes 612Y, 612M and 612C. Namely, an opening in the same shape as the supply hole 612Y, 612M, 612C is formed in a central region of each seal sponge 630Y, 630M, 630C. The thickness and the compression amount of each seal sponge 630Y, 630M, 630C are the same as those in the first embodiment. When the supply holes 612Y, 612M and 612C are in the closed state by the shutter 620, the seal sponges 630Y, 630M and 630C are compressed between the under surface 611 and the shutter 620 and seal a gap between the under surface 611 and the shutter 620. When the supply holes 612Y, 612M and 612C are in the closed state by the shutter 620, the developing agents stored in the developing agent container parts 640Y, 640M and 640C of container 610 do not leak to the outside thanks to the seal sponges 630Y, 630M and 630C.

Further, the developing agent container 600 includes the developing agent container parts 640Y, 640M and 640C, the supply holes 612Y, 612M and 612C provided on the under surface 611, the shutter 620, a spring 660 as a biasing member for applying pressing force in the +Y direction to the shutter 620, and a stirring member 650 that stirs the developing agents stored in the developing agent container parts 640Y, 640M and 640C.

Figure 17:
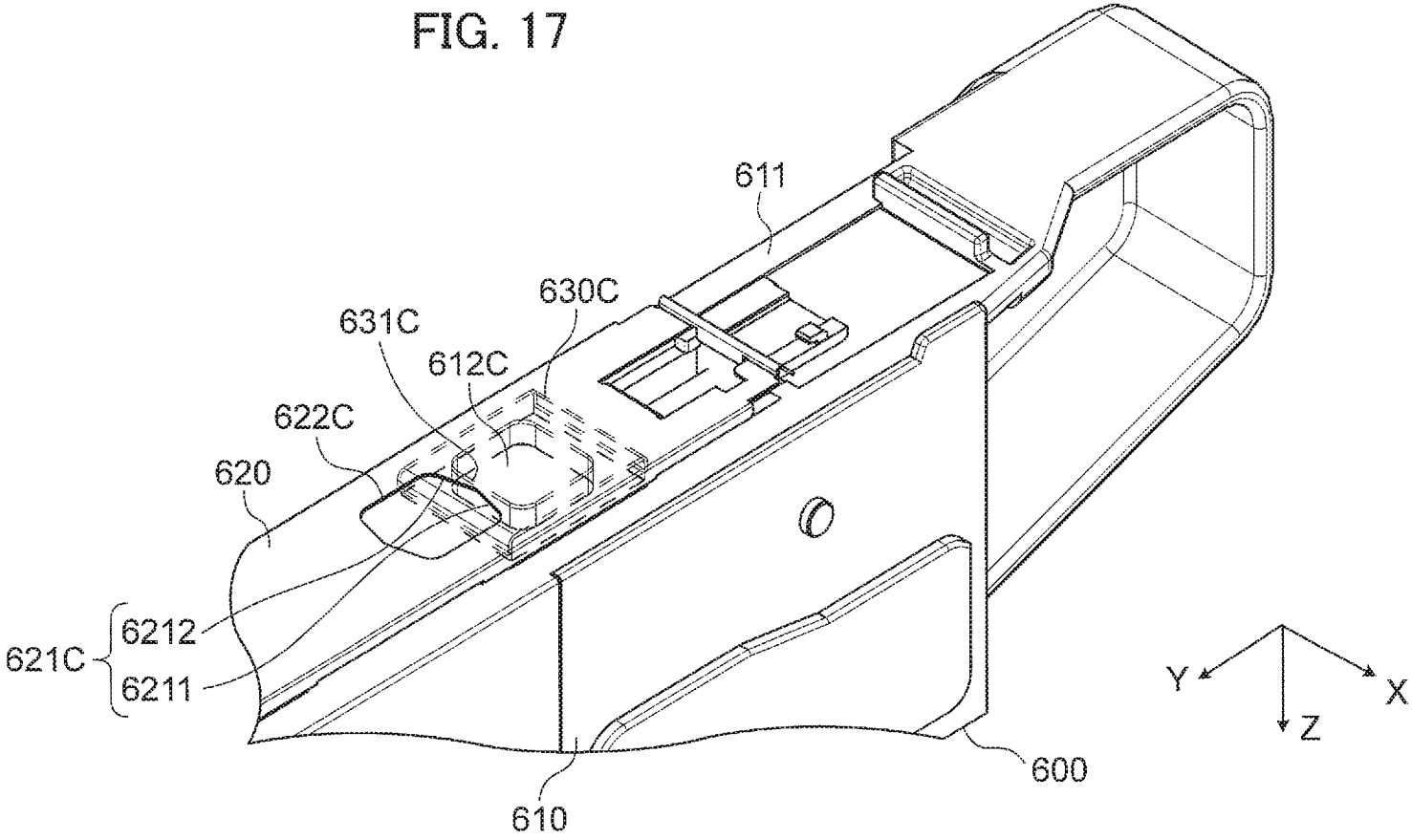
FIG. 17 is a perspective view showing a state of the developing agent container according to the second embodiment when the closing operation of the shutter is completed.

FIG. 16 is a perspective view showing a state of the developing agent container 600 according to the second embodiment in the middle of the closing operation of the shutter 620. FIG. 17 is a perspective view showing a state of the developing agent container 600 according to the second embodiment when the closing operation of the shutter 620 is completed.

A ridge line of an edge part (second edge part) 631Y, 631M, 631C of each seal sponge 630Y, 630M, 630C is a straight line in the X direction orthogonal to the Y direction. A ridge line of each edge part (first edge part) 621Y, 621M, 621C of the shutter 620 includes a first part 6211 inclined with respect to the X direction and a second part 6212 inclined with respect to the X direction and the first part 6211. When each edge part 621Y, 621M, 621C of the shutter 620 is viewed in the Z direction as the third direction orthogonal to both of the Y direction and the X direction, the shape of each edge part 621Y, 621M, 621C is a V-shape. In other words, the first part 6211 and the second part 6212 gradually project in the +Y direction with the increase in the distance from a central position of the shutter 620 in the X direction.

Figures 18A, 18B, 18C:
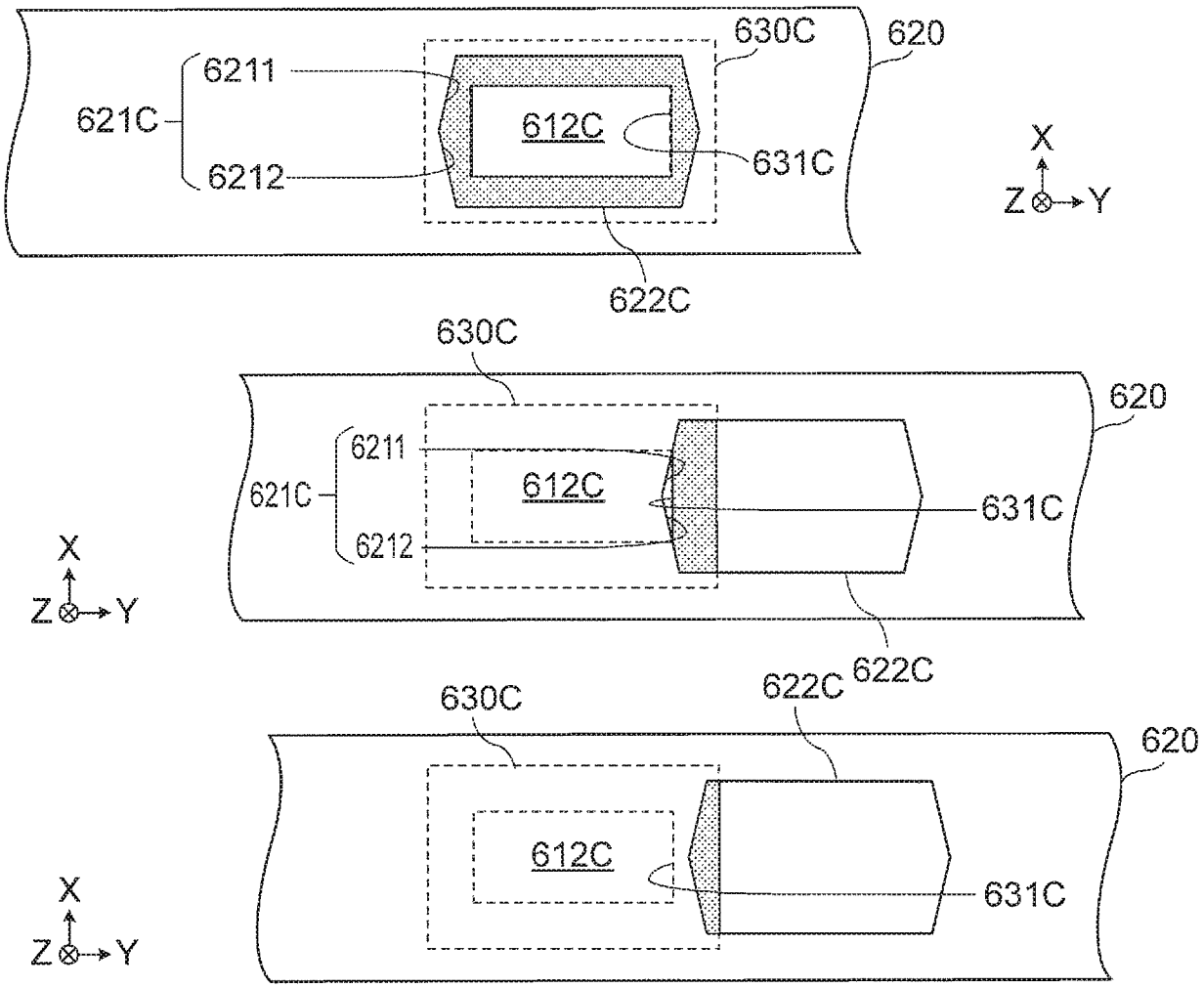
FIGS. 18A to 18C are bottom views showing the closing operation of a supply hole of the developing agent container according to the second embodiment.

FIGS. 18A to 18C are bottom views showing the closing operation of the supply hole 612C of the developing agent container 600 according to the second embodiment. In the closing operation of the shutter 620, the shutter 620 moves from the open state shown in FIG. 18A to the position shown in FIG. 18B and finally shifts to the closed state shown in FIG. 18C.

In the second embodiment, in the middle of moving the shutter 620 situated at the open position to the closed position, the ridge line (referred to also as a "first ridge line part") of the edge part 621C of the shutter 620 facing the +Y direction is inclined with respect to the ridge line (referred to also as a "second ridge line part") of the edge part 631C of the seal sponge 630C facing the supply hole 612C and the −Y direction as shown in FIG. 18B. Put another way, the shutter 620 has the first ridge line part that makes contact with the seal sponge 630C due to the movement of the shutter 620, in the edge part 621C on the front end side in the +Y direction, the seal sponge 630C has the second ridge line part that makes contact with the shutter 620 due to the movement of the shutter 620 in the +Y direction, in the edge part 631C on the −Y direction side facing the supply hole 612C, and the first ridge line part and the second ridge line part have the relationship in which one is inclined with respect to the other. In this case, as shown in FIG. 18B, there occurs no situation in which the whole region of the edge part 621C of the shutter 620 facing the +Y direction simultaneously makes contact with the whole region of the edge of the edge part 631C of the seal sponge 630C. Accordingly, there occurs no situation in which the whole region of the edge part 621C of the shutter 620 simultaneously applies strong force to the whole region of the edge part 631C of the seal sponge 630C. Thus, the curling hardly occurs to the edge part 631C of the seal sponge 630C. The other seal sponges 630Y and 630M also operate in the same way as the seal sponge 630C.

As described above, with the developing agent container 600 according to the second embodiment, the curling hardly occurs to the edge parts 631Y, 631M and 631C of the seal sponges 630Y, 630M and 630C, and thus an advantage is obtained in that the leakage of a developing agents due to the curling of the seal sponge 630Y, 630M or 630C hardly occurs.

DESCRIPTION OF REFERENCE CHARACTERS

1, 2: image forming apparatus, 10, 10K, 10C, 10M, 10Y: image forming unit, 11: photosensitive drum, 12: charging roller, 13, 13K, 13C, 13M, 13Y: print head, 14: development roller, 15: supply roller, 21, 21K, 21C, 21M, 21Y: coupling part, 22, 22K, 22C, 22M, 22Y: duct, 23, 23K, 23C, 23M, 23Y: connection part, 25: conveyance spiral, 80: transfer unit, 85: fixation device, 100: image forming section, 101: basket frame, 102: top cover, 200, 200K, 200C, 200M, 200Y: developing agent container, 211, 311, 511: under surface, 212, 312, 512: supply hole, 220, 320, 420: shutter, 230,330,530: seal sponge, 231, 331, 531: edge part, 600: developing agent container, 610: container, 611: under surface, 612Y, 612M, 612C: supply hole, 620: shutter, 621Y, 621M, 621C: edge part, 622Y, 622M, 622C: opening, 630Y, 630M, 630C: seal sponge, 631Y, 631M, 631C: edge part, 640Y, 640M, 640C: developing agent container part, 650: stirring member, 660: spring, 710Y, 710M, 710C: image forming unit, 720: stage.

What is claimed is:

1. A developing agent container comprising:

a container including a first surface having a supply hole for a developing agent;

a shutter provided on the container, the supply hole being set to a closed state by moving the shutter in a first direction as a direction along the first surface, the supply hole being set to an open state by moving the shutter in an opposite direction that is opposite to the first direction; and a seal sponge that is stuck to a region of the first surface surrounding the supply hole and seals a gap between the first surface and the shutter when the supply hole is in the closed state, wherein the shutter has a first edge that makes contact with the seal sponge due to the movement of the shutter, the first edge being provided in a first front edge part of the shutter, the first front edge part being formed on a front end side of the shutter in the first direction, the seal sponge has a second edge that makes contact with the shutter due to the movement of the shutter in the first direction, the second edge being provided in a second front edge part of the seal sponge, the second front edge part being formed on a side of the opposite direction of the seal sponge, said side facing the supply hole, a surface of the seal sponge is in contact with a surface of the shutter that is parallel to the first direction, the first edge and the second edge having a relationship in which both of the first edge and the second edge extend along the surface of the shutter, the first edge and the second edge intersecting each other when viewed in a direction orthogonal to the surface of the shutter, and at least one of the first edge and the second edge being inclined with respect to a second direction that is orthogonal to the first direction and is parallel to the surface of the shutter, the first surface of the container has a shape with a long side and a short side, the first direction being substantially parallel to a longitudinal direction along the long side of the first surface, the second edge of the second front edge part of the seal sponge is a straight line extending in the second direction, and the first edge of the first front edge part of the shutter includes a first part that is inclined with respect to the second direction and a second part that is inclined with respect to the second direction and the first part.

2. The developing agent container according to claim 1, wherein a shape of the first front edge part of the shutter viewed in a third direction orthogonal to both of the first direction and the second direction is a V-shape, and the first part and the second part gradually project in the first direction with the increase in distance from a central position of the shutter in the second direction.

3. The developing agent container according to claim 1, wherein the shutter includes an opening that has the first edge, a shape of the first edge viewed in a third direction orthogonal to both of the first direction and the second direction being a V-shape, and the first part and the second part gradually project in the first direction with the increase in distance from a central position of the shutter in the second direction.

4. An image forming apparatus comprising the developing agent container according to claim 1.

5. A developing agent container, comprising:

a container including a first surface having at least one supply hole for a developing agent;

a shutter provided on the container, the supply hole being set to a closed state by moving the shutter in a first direction as a direction along the first surface, the supply hole being set to an open state by moving the shutter in an opposite direction that is opposite to the first direction; and a seal sponge that is stuck to a region of the first surface surrounding the supply hole and seals a gap between the first surface and the shutter when the supply hole is in the closed state, wherein the shutter includes at least one opening that has a first edge that makes contact with the seal sponge due to the movement of the shutter in the first direction, the first edge being provided in a front end of the opening in the first direction, the seal sponge has a second edge that makes contact with the shutter due to the movement of the shutter in the first direction, the second edge being provided in a second front edge part of the seal sponge, the second front edge part being formed at a side of the opposite direction of the seal sponge, said side facing the supply hole, a surface of the seal sponge is in contact with a surface of the shutter that is parallel to the first direction, the first edge and the second edge having a relationship in which both of the first edge and the second edge extend along the surface of the shutter, the first edge and the second edge intersecting each other when viewed in a direction orthogonal to the surface of the shutter, and at least one of the first edge and the second edge being inclined with respect to a second direction that is orthogonal to the first direction and is parallel to the surface of the shutter, and the first surface of the container has a shape with a long side and a short side, the first direction being substantially parallel to a longitudinal direction along the long side of the first surface.

6. The developing agent container according to claim 5, wherein the shutter includes a plurality of openings as the at least one opening.

7. The developing agent container according to claim 6, wherein the plurality of openings are arranged in the first direction.

8. The developing agent container according to claim 6, wherein the container includes a plurality of container parts each having supply holes as the at least one supply hole respectively, and the openings overlap with the supply holes respectively when the shutter is in the open state.

9. The developing agent container according to claim 5, wherein the second edge of the seal sponge extends in the second direction, and the first edge of the shutter includes a first part that is inclined with respect to the second direction and a second part that is inclined with respect to the second direction and the first part.

10. The developing agent container according to claim 9, wherein a shape of the first edge viewed in a third direction orthogonal to both of the first direction and the second direction is a V-shape, and the first part and the second part gradually project in the first direction with the increase in distance from a central position of the shutter in the second direction.

11. An image forming apparatus comprising the developing agent container according to claim 5.

* * * * *